US010378560B2

(12) United States Patent
Tanaka et al.

(10) Patent No.: US 10,378,560 B2
(45) Date of Patent: Aug. 13, 2019

(54) HYDRAULIC SYSTEM FOR WORK MACHINE

(71) Applicants: KUBOTA CORPORATION, Osaka-shi (JP); KYB Corporation, Tokyo (JP)

(72) Inventors: Yoshimitsu Tanaka, Sakai (JP); Kunihiko Bito, Sakai (JP); Tsukasa Haraguchi, Sakai (JP); Toshiaki Otani, Sakai (JP); Yuji Kawano, Sakai (JP); Masaru Kumatani, Sakai (JP); Junki Maeda, Sakai (JP); Shoichi Kawano, Sakai (JP); Hitoshi Iwamura, Sakai (JP); Teruo Kunizawa, Sakai (JP); Takehiro Wakasugi, Sakai (JP); Akio Matsuura, Tokyo (JP)

(73) Assignees: KUBOTA CORPORATION, Osaka-Shi (JP); KYB CORPORATION, Tokyo (JP)

( * ) Notice: Subject to any disclaimer, the term of this patent is extended or adjusted under 35 U.S.C. 154(b) by 177 days.

(21) Appl. No.: 15/391,740

(22) Filed: Dec. 27, 2016

(65) Prior Publication Data

US 2017/0284425 A1 Oct. 5, 2017

(30) Foreign Application Priority Data

Mar. 31, 2016 (JP) ..... 2016-073532
Mar. 31, 2016 (JP) ..... 2016-073533

(51) Int. Cl.
*F15B 11/16* (2006.01)
*F15B 21/044* (2019.01)
(Continued)

(52) U.S. Cl.
CPC ..... *F15B 11/168* (2013.01); *E02F 3/422* (2013.01); *E02F 9/2221* (2013.01);
(Continued)

(58) Field of Classification Search
CPC .. F15B 21/044; F15B 11/1612; F15B 11/161; F15B 2211/635; F15B 2211/6355; F15B 11/162
(Continued)

(56) References Cited

U.S. PATENT DOCUMENTS 6,170,261 B1 1/2001 Ishizaki et al.
9,045,880 B2 * 6/2015 Horii ..... E02F 9/2239
2009/0007464 A1 * 1/2009 Itou ..... E02F 9/226 37/428

FOREIGN PATENT DOCUMENTS

EP 2431538 A1 3/2012
EP 2537990 A2 12/2012
(Continued)

OTHER PUBLICATIONS

Partial European Search Report for corresponding EP Application No. 16206929.8-1712, dated Jul. 19, 2017.

*Primary Examiner* — F Daniel Lopez
*Assistant Examiner* — Daniel S Collins
(74) *Attorney, Agent, or Firm* — Mori & Ward, LLP

(57) ABSTRACT

A hydraulic system for a work machine includes a first switch valve and a first return circuit. The first switch valve is switchable between a confluent position and an isolation position. The first switch valve is switched to the confluent position such that a first operation fluid tube is connected to a second operation fluid tube and a first transmission fluid tube is connected to a second transmission fluid tube. The first switch valve is switched to the isolation position such that the first operation fluid tube is disconnected from the second operation fluid tube and the first operation fluid tube is disconnected from the second operation fluid tube.

13 Claims, 8 Drawing Sheets

(51) Int. Cl.

| | |
|---|---|
| ***F15B 11/10*** | (2006.01) |
| ***F15B 1/26*** | (2006.01) |
| ***E02F 3/42*** | (2006.01) |
| ***E02F 9/22*** | (2006.01) |

(52) U.S. Cl.
CPC ..... *E02F 9/2239* (2013.01); *E02F 9/2246* (2013.01); *E02F 9/2285* (2013.01); *E02F 9/2289* (2013.01); *E02F 9/2292* (2013.01); *E02F 9/2296* (2013.01); *F15B 1/26* (2013.01); *F15B 11/10* (2013.01); *F15B 21/044* (2013.01); *F15B 2211/35* (2013.01); *F15B 2211/55* (2013.01); *F15B 2211/7052* (2013.01); *F15B 2211/7058* (2013.01); *F15B 2211/71* (2013.01); *F15B 2211/78* (2013.01)

(58) Field of Classification Search
USPC ..... 60/453
See application file for complete search history.

(56) References Cited

FOREIGN PATENT DOCUMENTS

| | | | |
|---|---|---|---|
| EP | 2537990 | A3 | 12/2012 |
| JP | 6-94004 | | 4/1994 |
| JP | 2004-324711 | | 11/2004 |
| JP | 2013-002241 | | 1/2013 |

* cited by examiner

HYDRAULIC SYSTEM FOR WORK MACHINE

CROSS-REFERENCE TO RELATED APPLICATIONS

The present application claims priority under 35 U.S.C. § 119 to Japanese Patent Application No. 2016-073533, filed Mar. 31, 2016, and to Japanese Patent Application No. 2016-073532, filed Mar. 31, 2016. The contents of these applications are incorporated herein by reference in their entirety.

BACKGROUND OF THE INVENTION

Field of the Invention

The present invention relates to a hydraulic system for a work machine.

Discussion of the Background

Japanese Unexamined Patent Application Publication No. 2013-2241 has disclosed a technique for a hydraulic system for a work machine (a backhoe). The work machine disclosed in Japanese Unexamined Patent Application Publication No. 2013-2241 includes an operation device having a boom, an arm, and a bucket and includes a travel device having a left travel device and a right travel device. The boom is moved by a boom cylinder. The arm is moved by an arm cylinder. The bucket is moved by a bucket cylinder. The left travel device is driven by a left travel motor. The right travel device is driven by a right travel motor.

The hydraulic system for the operation device includes a first control valve, a second control valve, a variable displacement hydraulic pump. The first control valve is configured to control the right travel motor and the arm cylinder. The second control valve is configured to control the left travel motor, the boom cylinder, and the bucket cylinder. The variable displacement hydraulic pump includes a first pump port and a second pump port.

In addition, the hydraulic system includes a first operation fluid tube, a second operation fluid tube, a first transmission fluid tube, and a second transmission fluid tube. The first operation fluid tube is configured to supply an operation fluid from the first pump port to the first control valve. The second operation fluid tube is configured to supply an operation fluid from the second pump port to the second control valve. The first transmission fluid tube is configured to transmit a load pressure of an actuator controlled by the first control valve. The second transmission fluid tube is configured to transmit a load pressure of an actuator controlled by the second control valve.

Moreover, the hydraulic system includes a switch valve configured to be switched between a confluent position and an isolation position. At the confluent position, the first operation fluid tube communicates with the second operation fluid tube, and the first transmission fluid tube communicates with the second transmission fluid tube. At the isolation position, the communication between the first operation fluid tube and the second operation fluid tube is released, and the communication between the first transmission fluid tube and the second transmission fluid tube is released. The switch valve is switched to the confluent position in order to move the operation device. The switch valve is switched to the isolation position in order to operate the travel device without moving the operation device.

In addition, the hydraulic system includes a first return circuit and a second return circuit. The first return circuit is configured to return the operation fluid in the first transmission fluid tube to a tank. The second return circuit is configured to return the operation fluid in the second transmission fluid tube to a tank.

SUMMARY OF THE INVENTION

According to one aspect of the present invention, a hydraulic system for a work machine includes a first control valve to control a first hydraulic actuator, a second control valve to control a second hydraulic actuator, a tank to store an operation fluid, a first operation fluid tube through which the operation fluid is to be supplied to the first control valve, a second operation fluid tube through which the operation fluid is to be supplied to the second control valve, a first transmission fluid tube through which a load pressure of the first hydraulic actuator controlled by the first control valve is to be transmitted, a second transmission fluid tube through which a load pressure of the second hydraulic actuator controlled by the second control valve is to be transmitted, a first switch valve switchable between a confluent position and an isolation position, the first switch valve being switched to the confluent position such that the first operation fluid tube is connected to the second operation fluid tube and the first transmission fluid tube is connected to the second transmission fluid tube, the first switch valve being switched to the isolation position such that the first operation fluid tube is disconnected from the second operation fluid tube and the first transmission fluid tube is disconnected from the second transmission fluid tube, a first return circuit to be connected to the first transmission fluid tube such that the operation fluid in the first transmission fluid tube is to be returned to the tank when the first switch valve is switched to the isolation position, the first return circuit being to be disconnected from the first transmission fluid tube when the first switch valve is switched to the confluent position, and a second return circuit through which the operation fluid in the second transmission fluid tube is returned to the tank when the first switch valve is switched to one of the confluent position and the isolation position.

According to another aspect of the present invention, a hydraulic system for a work machine includes a tank to store an operation fluid, a hydraulic actuator to be driven using the operation fluid, a plurality of pilot switch valves to control the hydraulic actuator, an operation device to operate the plurality of pilot switch valve using the operation fluid, and an air release circuit through which a part of the operation fluid used for operating the plurality of pilot switch valve is to be returned to the tank, the air release circuit being shared by the plurality of pilot switch valves.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
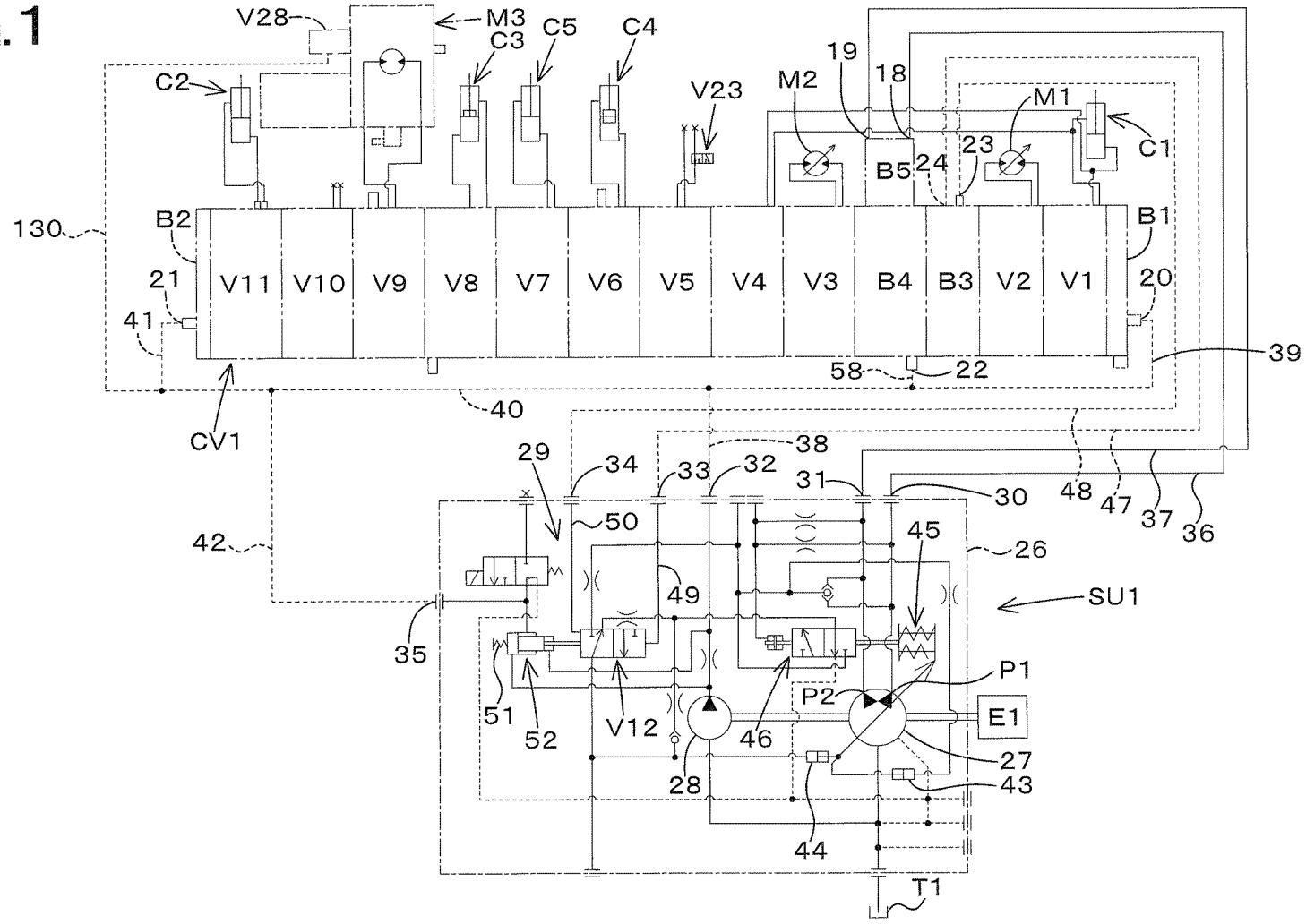
FIG. 1 is a view illustrating a schematic diagram of a hydraulic system according to an embodiment of the present invention.

The embodiment will now be described with reference to the accompanying drawings, wherein like reference numerals designate corresponding or identical elements throughout the various drawings. The drawings are to be viewed in an orientation in which the reference numerals are viewed correctly.

Referring to drawings, embodiments of the present invention will describe below a hydraulic system for a work machine and a work machine having the hydraulic system.

Figure 8:
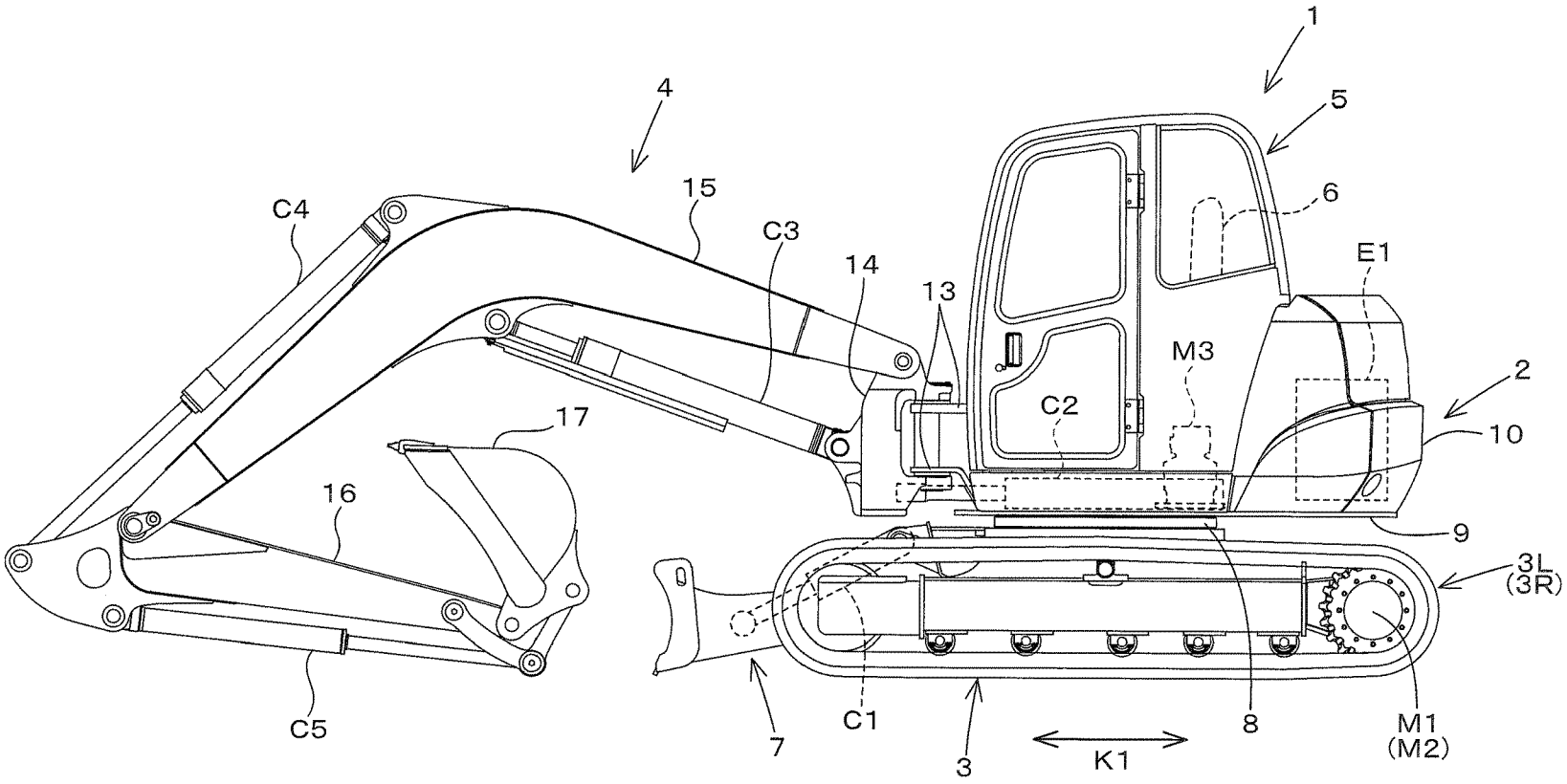
FIG. 8 is a side view illustrating a whole configuration of a work machine according to the embodiment.

FIG. 8 is a schematic side view illustrating a whole configuration of a work machine 1 according to an embodiment of the present invention. In the embodiment, a backhoe that is a swiveling work machine is exemplified as a work machine 1 according to the embodiment.

Whole Configuration of Work Machine

A whole configuration of a work machine 1 according to the embodiment of the present invention will be explained first.

As shown in FIG. 8, the work machine 1 according to the embodiment includes a machine body (a turn base) 2, a travel device 3, and an operation device 4. A cabin 5 is mounted on the machine body 2. An operator seta 6 is disposed inside the cabin 5.

Hereinafter, in explanations of all the embodiments of the present invention, a forward direction (a direction shown by an arrowed line F in FIG. 8) corresponds to a front side of an operator seating on an operator seat 6 of the work machine 1, a backward direction (a direction shown by an arrowed line B in FIG. 8) corresponds to a back side of the operator, a leftward direction (a direction vertically extending from a back surface to a front surface of FIG. 8) corresponds to a left side of the operator, and a rightward direction (a direction vertically extending from the front surface to the back surface of FIG. 8) corresponds to a right side of the operator. In addition, a machine width direction corresponds to a horizontal direction perpendicular to a front to rear direction K1.

As shown in FIG. 8, the travel device 3 includes a first travel device 3L and a second travel device 3R. The first travel device 3L is disposed on the left portion of a frame of the travel device 3. The second travel device 3R is disposed on the right portion of the frame of the travel device 3. In other words, the first travel device 3L is disposed on a left portion of a lower portion of the machine body 2. The second travel device 3R is disposed on a right portion of the lower portion of the machine body 2.

Each of the first travel device 3L and the second travel device 3R is constituted of a crawler travel device in the embodiment. The first travel device 3L is capable of being driven by a first travel motor M1. The second travel device 3R is capable of being driven by a second travel motor M2 other than the first travel device 3L. Each of the first travel device 3L and the second travel device 3R is constituted of a hydraulic motor (a hydraulic actuator).

A dozer device 7 is attached to a front portion of the travel device 3. The dozer device 7 is capable of stretching and shortening a dozer cylinder C1, and thereby moves upward and downward (moves a blade upward and downward).

The machine body 2 is supported by a frame of the travel device 3. The machine body 2 is capable of being turned about a vertical axis (an axis extending vertically) by a turn bearing 8. The machine body 2 is driven to be turned by a turn motor M3. The turn motor M3 is constituted of a hydraulic motor (a hydraulic actuator). The machine body 2 includes a base plate and a weight 10. The base plate is to be turned about the vertical axis (hereinafter referred to as a turn base plate).

The turn base plate 9 is formed of a steel plate or the like, and is coupled to the turn bearing 8. The weight 10 is disposed on a rear portion of the machine body 2. An engine E1 is mounted on the rear portion of the machine body 2.

The machine body 2 includes a support bracket 13 disposed slightly rightward from a center in the machine width direction on a front portion of the machine body 2. A swing bracket 14 is attached to the support bracket 13. The swing bracket 14 is capable of swinging around the vertical axis. The operation device 4 is attached to the swing bracket 14.

As shown in FIG. 8, the operation device 4 includes a boom 15, an arm 16, and a bucket (an operation tool) 17. A base portion of the boom 15 is pivotally attached to the swing bracket 14. Thus, the base portion of the boom 15 is capable of turning about a lateral axis (an axis extending in the machine width direction). In this manner, the boom 15 moves upward and downward.

The arm 16 is pivotally attached to a tip end portion of the boom 15. Thus, the arm 16 is capable of turning about the lateral axis. In this manner, the arm 16 moves forward and backward, and moves upward and downward.

The bucket 17 is disposed on a tip end portion of the arm 16. Thus, the bucket 17 is capable of performing the shoveling operation and a dumping operation.

The work machine 1 is capable of installing other operation tools (hydraulic attachments) instead of or in addition to the bucket 17, the other operation tools being configured to be driven by a hydraulic actuator. The following attachments (spare attachments) are exemplified as the other work tools; for example, a hydraulic crusher, a hydraulic breaker, an angle broom, an earth auger, a pallet fork, a sweeper, a mower, a snow blower, and the like.

The swing bracket 14 is capable of being swung by the stretching and shortening of a swing cylinder C2 disposed in the machine body 2.

The boom 15 is capable of being swung by the stretching and shortening of a boom cylinder C3. The arm 16 is capable of being swung by the stretching and shortening of an arm cylinder C4. The stretching and shortening of a bucket cylinder (an operation tool cylinder) C5 enables the bucket 17 to perform the shoveling operation and the dumping operation.

Each of the dozer cylinder C1, the swing cylinder C2, the boom cylinder C3, the arm cylinder C4, and the bucket cylinder C5 is constituted of a hydraulic cylinder (a hydraulic actuator).

Meanwhile, the boom 15 may have a two-piece configuration. In the two-piece configuration, the boom 15 is constituted of two members, a front boom and a rear boom, and is capable of being bent at a coupling portion of the front boom and the rear boom. In the two-piece configuration, a second boom cylinder is installed in addition to the boom cylinder C3. The second boom cylinder is provided for the bending of the boom 15 at the coupling portion.

Hydraulic System

Referring to FIG. 1 to FIG. 7, a hydraulic system (a hydraulic system for a work machine) will be explained below. The hydraulic system operates various types of hydraulic actuators M1 to M3 and C1 to C5 installed in the work machine 1 and operates a hydraulic actuator additionally installed in the work machine 1.

As shown in FIG. 1, the hydraulic system includes a control valve CV1, a pressured fluid supply unit SU1, and a tank T1 configured to store a hydraulic fluid. An operation fluid stored in the tank T1 is used for driving the hydraulic actuator, for the control of the hydraulic system, and for a signal.

For convenience of the explanation, the operation fluid used for the control and the signal is referred to as "a pilot fluid", and a pressure of the pilot fluid is referred to as "a pilot pressure". In addition, the operation fluid may be referred to as "a pressured fluid".

The hydraulic system employs a load sensing system.

When a plurality of hydraulic actuators of the hydraulic actuators M1 to M3 and C1 to C5 installed in the work machine 1 are operated at the same time, the load sensing system controls loads generated among the hydraulic actuators M1 to M3 and C1 to C5 (activates a pressure compensation valves E1 to E11 described later as a controller of the loads), generates a pressure loss corresponding to a differential pressure in control valves V1 to V11 on a low load pressure side, the differential pressure generated between the low load pressure and the maximum load pressure, and supplies (distributes) a flow rate to the control valves V1 to V11 actually operated regardless of strength of the load, the flow rate corresponding to an operation amount of each of operations of the control valves V1 to V11.

In addition, the load sensing system controls the discharge rate (discharge amount) of the operation fluid in accordance with the load pressure of the hydraulic actuators M1 to M3 and C1 to C5 installed in the work machine 1, the operation fluid being discharged from the first pump 27 described later (a load sensing control), and then discharges a hydraulic power required for the load from the first pump 27, thereby saving the power and improving the operability.

Outline of Control Valve

The control valve CV1 is a valve unit integrally arranging the plurality of control valves V1 to V11, a plurality of end blocks B1 and B2, and a plurality of valve blocks B3 and B4 in one direction. In addition, the control valve CV1 includes a valve block B5 disposed on the valve block B4.

In FIG. 1, the control valves V1 to V11, the end block B1, and the valve blocks B3 and B4 are arranged in the order of the control valve V1, the control valve V2, the valve block B3, the valve block B4, the control valve V3, the control valve V4, the control valve V5, the control valve V6, the control valve V7, the control valve V8, the control valve V9, the control valve V10, the control valve V11, and the end block B2 from the right and connected to each other.

The plurality of control valves V1 to V11 are valves for operating the hydraulic actuators M1 to M3 and C1 to C5 installed in the work machine 1 and operating the hydraulic actuator additionally installed in the work machine 1.

The control valve V1 is a first dozer valve for controlling the dozer cylinder C1. The control valve V2 is a first travel valve for controlling the first travel motor M1. The control valve V3 is a second travel valve for controlling the second travel motor M2.

The control valve V4 is a valve for controlling the dozer cylinder C1, that is, a second dozer valve other than the control valve V1. The control valve V5 is a first auxiliary valve for controlling a hydraulic attachment additionally installed. The control valve V6 is an arm valve for controlling the arm cylinder C4.

The control valve V7 is a bucket valve (an operation tool valve) for controlling the bucket cylinder C5. The control valve V8 is a boom valve for controlling the boom cylinder C3. The control valve V9 is a turn valve for controlling the turn motor M3.

The control valve V10 is a valve for controlling a hydraulic attachment additionally installed, that is, a second auxiliary valve other than the control valve V5. The control valve V11 is a swing valve for controlling the swing cylinder C2.

The control valve V1 and the control valve V2 constitute a first control valve. That is, the first control valve is a valve for controlling the hydraulic actuators (the dozer cylinder C1 and the first travel motor M1). In addition, the first control valve includes at least the first travel valve V2, and also includes the first dozer valve V1 in the embodiment.

The control valves V3 to V11 constitute a second control valve. That is, the second control valve is a valve for controlling the hydraulic actuators (the second travel motor M2, the dozer cylinder C1, the hydraulic attachment, the arm cylinder C4, the bucket cylinder C5, the boom cylinder C3, the turn motor M3, and the swing cylinder C2).

In addition, the second control valve includes at least the second travel valve V3. In the embodiment, the second control valve additionally includes the second dozer valve V4, the first auxiliary valve V5*m* the arm valve V6, the bucket valve V7, the boom valve V8, the turn valve V9, the second auxiliary valve V10, and the swing valve V11.

Meanwhile, the first auxiliary valve V5, the arm valve V6, the bucket valve V7, the boom valve V8, the turn valve V9, the second auxiliary valve V10, and the swing valve V11 are disposed on the first control valve or the second control valve.

The control valve CV1 includes input ports 18 to 22 and output ports 23 and 24. The input port 18 and the input port 19 are ports for receiving input of the operation fluid discharged from the first pump 27 described later, and is disposed on the valve block B5.

The input port 20 is disposed on the end block B1. The input port 21 is disposed on the end block B2. The input port 22 is disposed on the valve block B4. The output port 23 and the output port 24 are disposed on the valve block B3.

The output port 23 is a port for outputting PLS signal pressures (PLS: Pressure of Load Sensing) that are the highest load pressure in the hydraulic actuators M1 to M3 and C1 to C5. The output port 24 is a port for outputting a PPS signal pressure (PPS: Pressure of Pump Sensing) that is a discharge pressure of the first pump 27.

Pressured Fluid Supply Unit

The pressured fluid supply unit SU1 includes a unit body 26, a first pump 27, a second pump 28, and a control part (a controller) 29. The first pump 27, the second pump 28, the control part 29 are incorporated in the unit body 26.

The first pump 27 is a hydraulic pump configured to suck the fluid stored in the tank T1 and to discharge the operation fluid (supply the operation fluid) to operate the hydraulic actuators M1 to M3 and C1 to C5. The second pump 28 is a hydraulic pump configured to discharge the pilot fluid. The first pump 27 and the second pump 28 are driven by the engine E1.

The first pump 27 is a hydraulic pump having a function of a uniform flow double pump configured to supply the pressured fluids (the operation fluids) from independent two discharge ports in an identical flow rate, and is constituted of a variable displacement axial pump having a swash plate capable of changing a discharging flow rate.

In particular, the first pump 27 employs a hydraulic pump of a split flow type. The hydraulic pump of the split flow type has a function to discharge the pressured fluid from a single piston-cylinder barrel kit alternately to discharge grooves formed inside and outside a valve plate.

Of the two discharge ports to discharge the operation fluid from the first pump 27, one of the discharge ports is referred to as a first pump port P1. The other one of the discharge ports referred to as is a second pump port P2.

Meanwhile, the first pump 27 may be constituted of two hydraulic pumps independent from each other. In that case, a discharge port of one of the independent two hydraulic pumps serves as the first pump port, and a discharge port of the other one of the independent two hydraulic pumps serves as the second pump port.

The second pump 28 is constituted of a gear pump having a constant capacity (a constant capacity gear pump). The second pump 28 is a hydraulic pump configured to suck the fluid stored in the tank T1 and to discharge the operation fluid (supply the operation fluid).

Output ports 30 to 32 and input ports 33 to 35 are disposed on the unit body 26. The output port 30 outputs the operation fluid to be discharged from the first pump port P1. The output port 30 is connected to the input port 18 by a supply fluid tube 36.

The output port 31 outputs the operation fluid to be discharged from the second pump port P2. The output port 31 is connected to the input port 19 by a supply fluid tube 37.

The output port 32 outputs the operation fluid to be discharged from the second pump 28. The output port 32 is connected to the input port 20 by the supply fluid tube 38 and the supply fluid tube 39. In addition, the output port 32 is connected to the input port 21 by the supply fluid tube 38, the supply fluid tube 40, and the supply fluid tube 41.

In addition, the output port 32 is connected to the input port 22 by the supply fluid tube 38, the supply fluid tube 39, and the supply fluid tube 58. The output port 32 is connected to the input port by the supply fluid tube 38, the supply fluid tube 40, and the supply fluid tube 42. The input port 33 is connected to the output port 24 by a signal fluid tube (a PPS signal fluid tube) 47.

That is, the PPS signal pressure is inputted to the input port 33. The input port 34 is connected to the output port 23 by a signal fluid tube (a PLS signal fluid tube) 48. That is, the PLS signal pressure is inputted to the input port 34.

The control part 29 is a device configured to control a flow rate of the operation fluid discharged from the first pump 27. In other words, the flow rate control part 29 is a device configured to control the swash plate of the first pump 27.

The control part 29 includes a pushing device 43 and a swash plate control device 44. The pushing device 43 is configured to push the swash plate of the first pump 27. The swash plate control device 44 is provided for flow rate compensation, and is configured to control the swash plate of the first pump 27. The first pump 27 is configured to push the swash plate toward a direction in which the pump flow rate is increased by using the pushing device moving in accordance with a self-pressure of the first pump 27.

In addition, the control part 29 is configured to control the swash plate control device 44 to apply a force against a pressing force of the pressing device 43 to the swash plate. The control part 29 controls the pressure applied to the swash plate control device 44, and thereby the control part 29 controls a discharge flow rate from the first pump 27.

When the pressure applied to the control piston 4 is released, the first pump 27 discharges the operation fluid at the maximum flow rate under a state where an angle of the swash plate is maximized.

In addition, the control part 29 includes the control valve V12 for flow rate compensation. The control valve 12 controls the pressure applied to the swash plate control device 44, and thereby the swash plate of the first pump 27 is controlled.

The input port 33 is connected to one side portion of a spool of the control valve V12 by the fluid tube 48. That is, the discharge pressure (the PPS signal pressure) of the first pump 27 is applied to one end portion of the spool of the control valve V12. in addition, the input port 34 is connected to the other end portion of the spool of the control valve V12 by the fluid tube 50.

That is, the highest load pressure (the PLS signal pressure) of the hydraulic actuators is applied to the other end portion of the spool of the control valve V12. In addition, a spring 51 and a differential pressure cylinder 52 are disposed on the other end portion of the spool of the control valve V12. The spring 51 and the differential pressure cylinder 52 apply a control differential pressure to the control valve V12.

The control valve V12 controls the swash plate control device 43 on the basis of the PLS signal pressure and the PPS signal pressure. The swash control device 43 automatically controls the discharge flow rate (the discharge pressure) of the first pump 27 (the load sensing control) such that a differential pressure between the PPS signal pressure and the PLS signal pressure is equivalent to the control differential pressure.

That is, the hydraulic system (the load sensing system) includes the control part 29. The control part 29 controls a flow rate of the operation fluid to be discharged from the first pump port P1 and the second pump port P2 on the basis of the load pressures of the hydraulic actuators and a discharge pressure of the first pump 27 (the first pump port P1 or the second pump port P2).

In addition, the control part 29 includes a spool 46 and a spring 45. The spool 46 and the spring 45 are used for controlling a pump power (a pump torque) of the first pump 27. When the discharge pressure of the first pump 27 is equivalent to a pressure preliminarily determined, the spring 45 and the spool 46 limit the power (the torque) taken out from the engine E1 by the first pump 27.

Detailed configuration of the control valve CV1 will be explained below.

Figure 2:
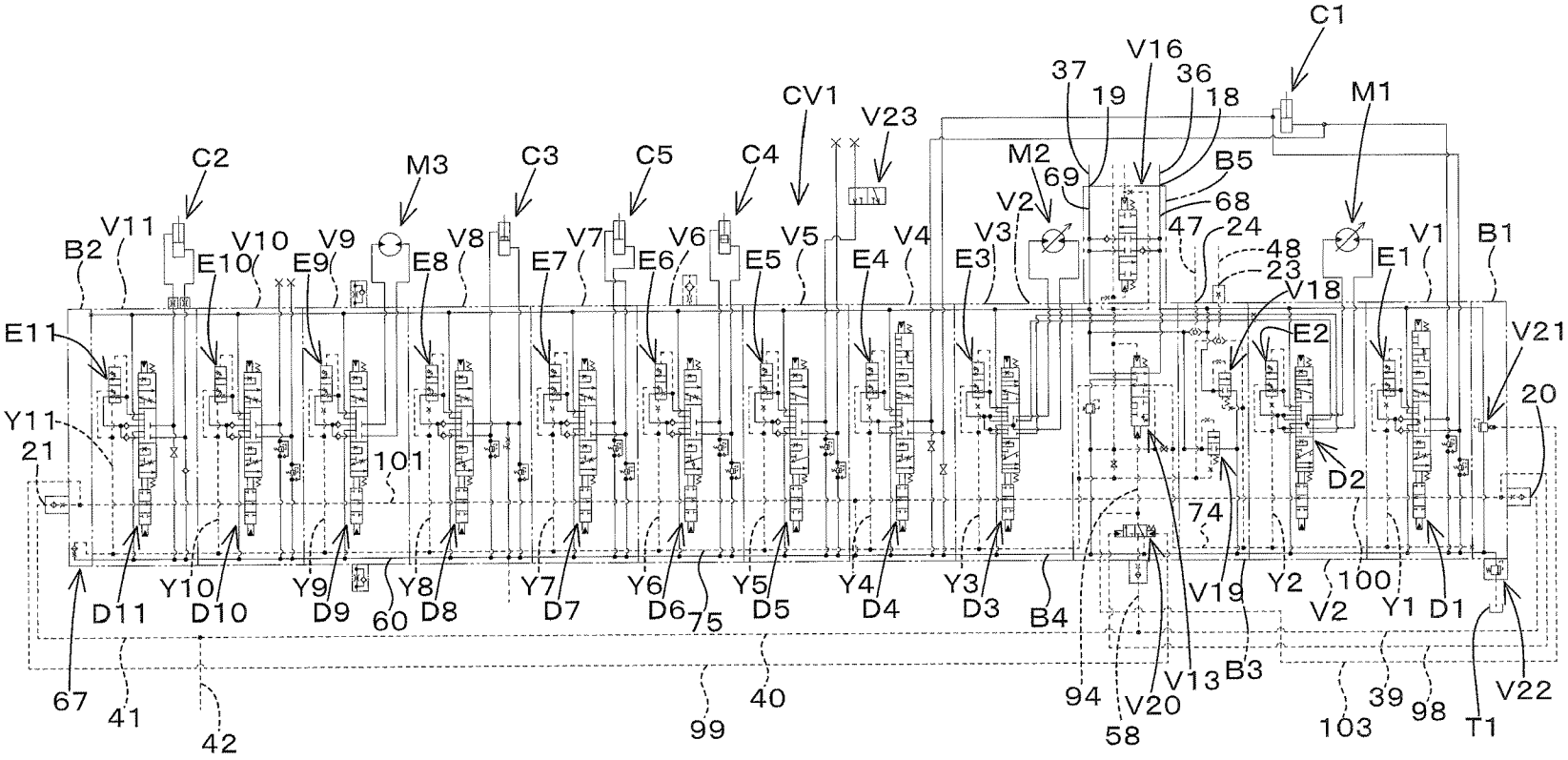
FIG. 2 is a view illustrating a circuit diagram of fluid tubes included in a control valve according to the embodiment.
Figure 3:
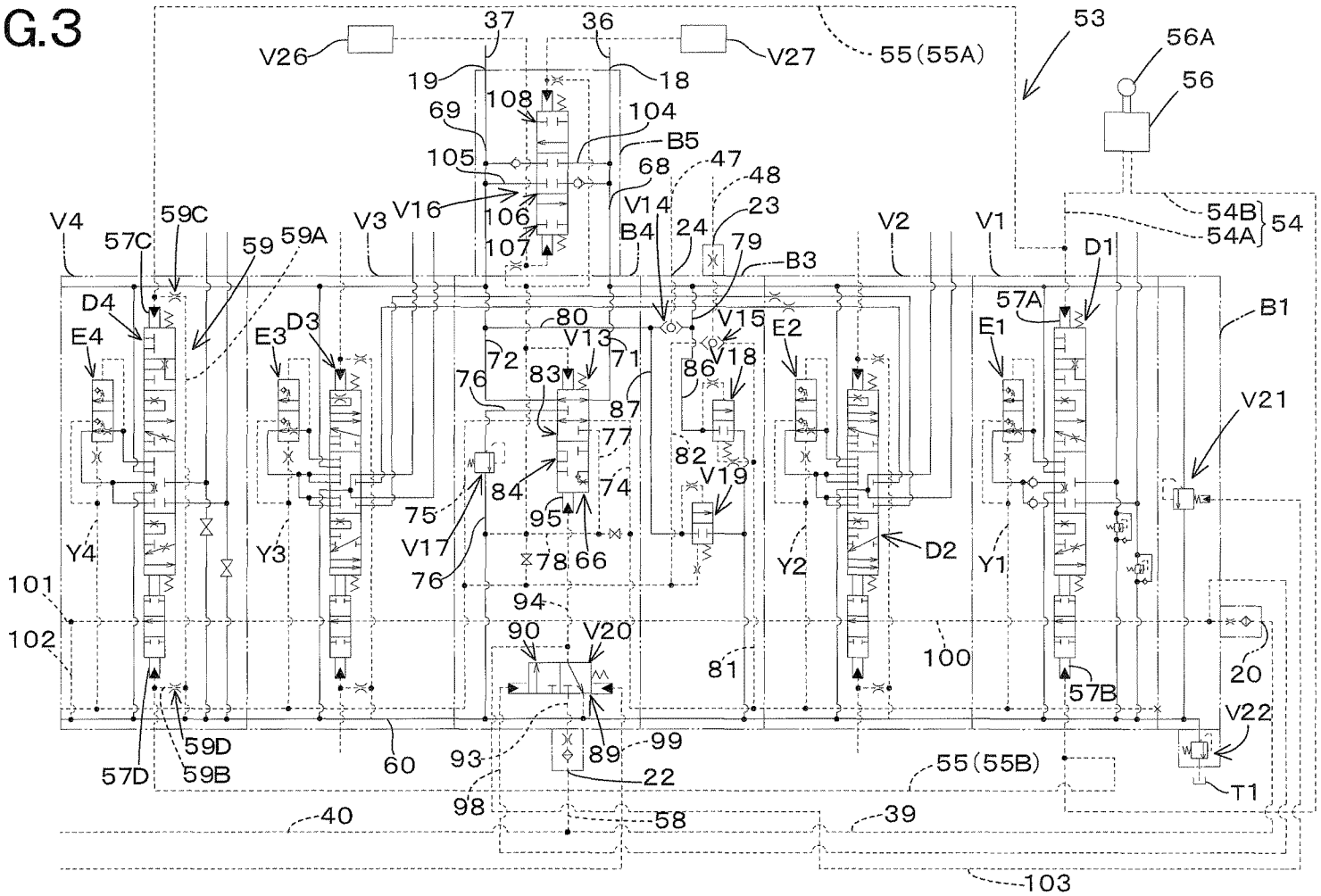
FIG. 3 is a view illustrating a circuit diagram of fluid tubes that shows a part of the control valve according to the embodiment.
Figure 4:
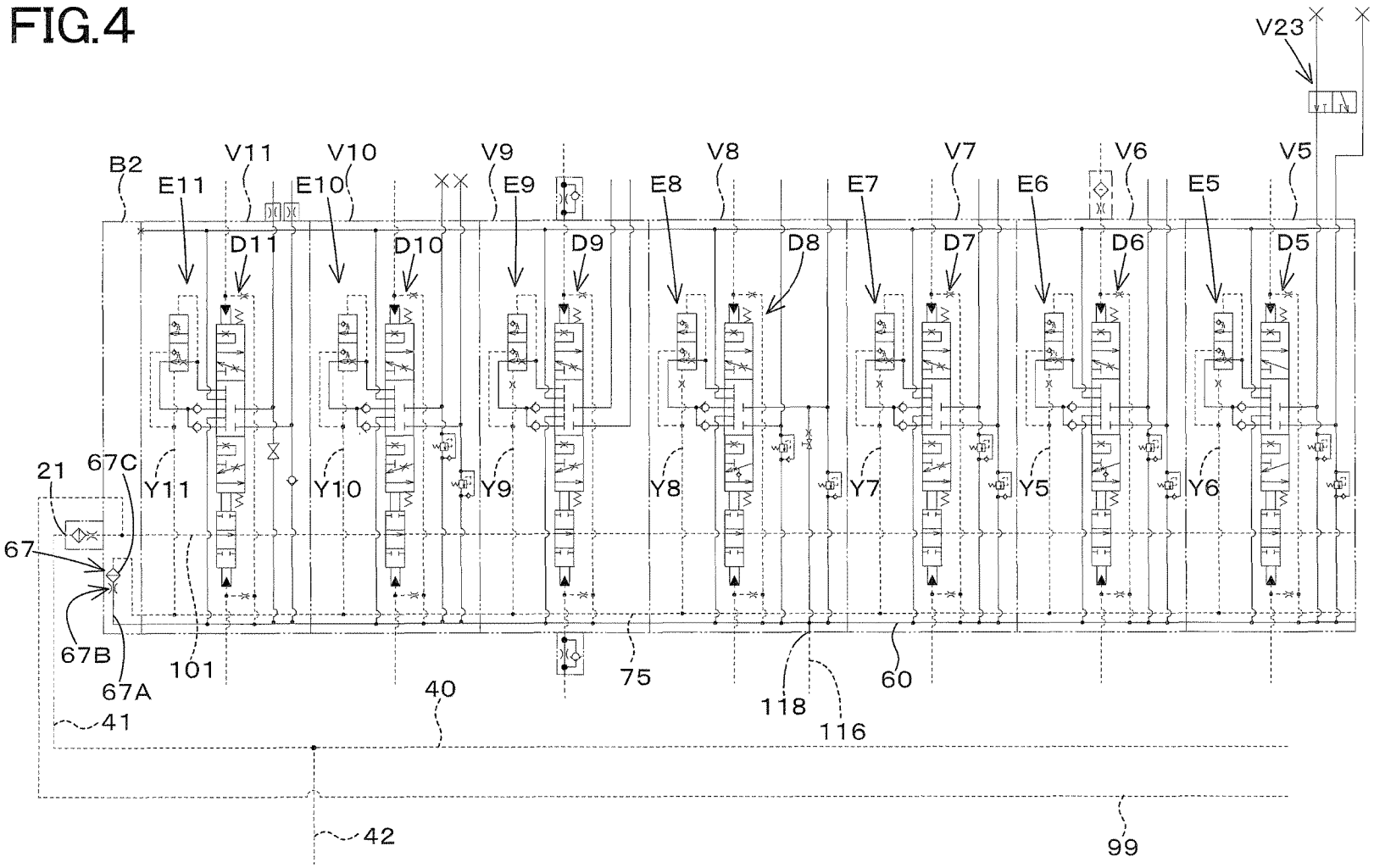
FIG. 4 is a view illustrating a circuit diagram of fluid tubes that shows a part of the control valve according to the embodiment.

As shown in FIG. 2 to FIG. 4, the control valves V1 to V11 include direction switch valves D1 to D11 and the pressure compensation valves E1 to E11 in the valve body.

The direction switch valves D1 to D11 are valves configured to switch a direction of the pressured fluid with respect to the hydraulic actuators M1 to M3 and C1 to C5 that are targets to be controlled.

Each of the direction switch valves D1 to D11 is a three-position switch valve having a direct-acting spool. In addition, the direction switch valves D1 to D11 are referred to as pilot (operation) switch valves configured to be switched by the pilot pressure (the pilot fluid).

The spools of the direction switch valves D1 to D11 constitute main spools of the control valves V1 to V11. Thus, the control valves V1 to V11 are referred to as the pilot (operation) switch valves configured to be switched by the pilot pressure (the pilot fluid).

In addition, the direction switch valves D1 to D11 move the spools in proportion to operation amounts of the operation devices, the operation devices being configured to operate the direction switch valves D1 to D11. The direction switch valves D1 to D11 are configured to supply the pressured fluid to the hydraulic actuators M1 to M3 and C1 to C5, the pressured fluid having an amount proportional to an amount of operation of the movements of the spools, (the operation speeds of the hydraulic actuators M1 to M3 and C1 to C5 to be operated can be changed in proportion to the operation amounts of the operation devices.).

The pressure compensation valves E1 to E11 are disposed on a downstream portion of the pressured fluid supplied to the direction switch valves D1 to D11 and on an upper stream portion of the pressured fluid supplied to the hydraulic actuators M1 to M3 to be controlled.

That is, the load sensing system according to the embodiment employs a load sensing system of an after-orifice type. The load sensing system of an after-orifice type arranges the pressure compensation valves E1 to E11 on the downstream portion of the pressured fluid supplied to the direction switch valves D1 to D11.

When some of the hydraulic actuators M1 to M3 and C1 to C5 are operated at the same time, the pressure compensation valves E1 to E11 control the loads among the hydraulic actuators M1 to M3 and C1 to C5, generates a pressure loss corresponding to a differential pressure in control valves V1 to V11 on a low load pressure side, the differential pressure generated between the low load pressure and the maximum load pressure, and supplies (distributes) a flow rate to the control valves V1 to V11 actually operated regardless of strength of the load, the flow rate corresponding to an operation amount of the spools of the direction switch valves D1 to D11.

Air Release Circuit of Pilot Fluid Tube of Dozer Valve

As shown in FIG. 3, the hydraulic system includes a remote control valve (an operation device) 56. The remote control valve 56 is used for controlling the dozer device 7. The remote control valve 56 includes a dozer lever (an operation member) 56A.

In addition, the remote control valve 56 is disposed in the vicinity of the operator seat 6. The remote control valve 56 is a pilot valve for operating the first control valve V1 (a first dozer valve) and the control valve V4 (a second dozer valve) by using the pilot pressure when the dozer lever 56A is operated.

In addition, the remote control valve 56 outputs the pilot fluid to both of the direction switch valve D1 and the direction switch valve D4 when the dozer lever 56A is operated. In this manner, the direction switch valve D1 and the direction switch valve D4 are activated simultaneously (operated at the same time). For convenience of the explanation, the direction switch valve D1 may be referred to as a "first pilot switch valve", and the direction switch valve D4 may be referred to as a "second pilot switch valve".

The hydraulic system includes a pilot circuit 53. The pilot circuit 53 is configured to supply the pilot fluid from the remote control valve 56 to the control valve V1 (the first pilot switch valve D1) and to the control valve V4 (the second pilot switch valve D4). The pilot circuit 53 is a circuit configured to supply the pilot fluid for switching order from the remote control valve 56 to the control valve V1 and the control valve V4. The pilot fluid for switching order is supplied to switch the direction switch valve D1 and the direction switch valve D4.

That is, the pilot circuit 53 configures an operation fluid flow tube (an operation fluid flow path) to supply the pilot fluid that is supplied from the remote control valve 56 (the operation device) to the first pilot switch valve D1 and the second pilot switch valve D4.

The pilot circuit 53 includes a first supply circuit 54 and a second supply circuit 55. The first supply circuit 54 is configured to supply the pilot fluid to the control valve V1. The second supply circuit 54 is configured to supply the pilot fluid to the control valve V4. The first supply circuit 54 includes a first pilot fluid tube 54A and a second pilot fluid tube 54B. The second supply circuit 55 includes a third pilot fluid tube 55A and a fourth pilot fluid tube 55B.

The first pilot fluid tube 54A has one end connected to the remote control valve 56 and has the other end connected to a pressure receiving part (a first pressure receiver) 57A of the direction switch valve D1. The second pilot fluid tube 54B has one end connected to the remote control valve 56 and has the other end connected to a pressure receiving part (a second pressure receiver) 57B of the direction switch valve D1.

The third pilot fluid tube 55A has one end connected to the first pilot fluid tube 54A and has the other end connected to a pressure receiving part (a third pressure receiver) 57C of the direction switch valve D4. The fourth pilot fluid tube 55B has one end connected to the second pilot fluid tube 54B and has the other end connected to a pressure receiving part (a fourth pressure receiver) 57D of the direction switch valve D4.

In the embodiment, the first supply circuit 54 is a circuit configured to supply the pilot fluid from the remote control valve 56 (the operation device) to the first pilot switch valve D1. The second supply circuit 55 is a circuit configured to supply the pilot fluid from the first supply circuit 54 to the second pilot switch valve D4.

Meanwhile, the first supply circuit 54 may be a circuit configured to supply the pilot fluid from the remote control valve 56 to the second pilot switch valve D4, and the second supply circuit 55 may be a circuit configured to supply the pilot fluid from the first supply circuit 55 to the first pilot switch valve D1.

That is, the pilot circuit 53 includes the first supply circuit 54 and the second supply circuit 55. The first supply circuit 54 is configured to supply the pilot fluid from the operation device 56 to one of the first pilot switch valve D1 and the second pilot switch valve D4. The second supply circuit 55 is configured to supply the pilot fluid from the first supply circuit 54 to the other one of the first pilot switch valve D1 and the second pilot switch valve D4.

In the embodiment, when the dozer lever 56A is swung forward, the pilot pressure is applied to the first pressure receiver 57A through the first pilot fluid tube 54A, and the pilot pressure is applied to the third pressure receiver 57C through the third pilot fluid tube 55A. In this manner, the direction switch valve D1 and the direction switch valve D4 are switched toward a direction for moving the dozer device 7 upward.

In addition, when the dozer lever 56A is swung backward, the pilot pressure is applied to the second pressure receiver 57B through the second pilot fluid tube 54B, and the pilot pressure is applied to the fourth pressure receiver 57D through the fourth pilot fluid tube 55B. In this manner, the direction switch valve D1 and the direction switch valve D4 are switched toward a direction for moving the dozer device 7 downward.

Of the control valve V1 (the first pilot switch valve D1) and the control valve V4 (the second pilot switch valve D4), an air release circuit 59 is disposed on the control valve V4, and the air release circuit 59 is not disposed on the control valve V1. That is, the air release circuit 59 is shared by both of the first pilot switch valve D1 and the second pilot switch valve D4 (the plurality of pilot switch valves).

In addition, the air release circuit 59 is disposed on the control valve 4 (the pilot switch valve D4). The control valve is disposed on a downstream of a fluid flow tube supplying the pilot fluid for switching order that is used for switching the direction switch valve (the first pilot switch valve) D1 and the direction switch valve (the second pilot switch valve) D4.

In other words, of the first pilot switch valve D1 and the second pilot switch valve D4, the air release circuit 59 is disposed on a side of the pilot switch valve disposed on a downstream of a fluid flow tube supplying the pilot fluid that is supplied from the operation device 56.

Meanwhile, the air release circuit 59 may be disposed not only on the downstream of a fluid flow tube supplying the pilot fluid but also on an upper stream of a fluid flow tube supplying the pilot fluid. That is, the air release circuit 59 may be disposed on the control valve V1 (the first pilot switch valve D1) or the control valve V4 (the second pilot switch valve D2).

Air may be introduced into the pilot fluid tubes 54A, 54B, 55A, and 55B in assembly of hydraulic piping such as hydraulic hoses constituting the pilot fluid tubes 54A, 54B, 55A, and 55B.

In addition, gas included in the fluid may be bubbled finely to be deposited when the fluid (the operation fluid) stands in the pilot fluid tubes 54A, 54B, 55A, and 55B under a state where the control valves V1 and V2 are not used. When the air is presented in the pilot fluid tubes 54A, 54B, 55A, and 55B, the dozer cylinder C1 (the hydraulic actuator) does not move smoothly.

The air release circuit 59 is a circuit configured to return the pilot fluids in the pilot fluid tubes 54A, 54B, 55A, and 55B to the tank T1 and thereby release the air (bubbles) in the pilot fluid tubes 54A, 54B, 55A, and 55B.

The air release circuit 59 includes a first release tube 59A, a second release tube 59B, a first throttle 59C, and a second throttle 59D. The first release tube 59A has one end connected to the third pilot fluid tube 55A and has the other end connected to the drain fluid tube 60.

The one end of the first release tube 59A is connected to a portion in the vicinity of the pressure receiving part 57C. The second release tube 59B has one end connected to the fourth pilot fluid tube 55B and has the other end connected to the first release tube 59A. The one end of the second release tube 59B is connected to a portion in the vicinity of the pressure receiving part 57D.

The first throttle 59C is disposed on the first release tube 59A. The first throttle 59C may be preferably disposed on a portion in the vicinity of a connecting portion between the third pilot fluid tube 55A and the first release tube 59A. The second throttle 59D is disposed on the second release tube 59B. The second throttle 59D may be preferably disposed on a portion in the vicinity of a connecting portion between the fourth pilot fluid tube 55B and the second release tube 59B.

The drain fluid tube 60 is disposed on the control valve CV1. The drain fluid tube 60 extends from the end block B3 to the end block B1 through the control valves V11 to V1 and the valve blocks B4 and B3. The drain fluid tube 60 communicates with the tank T1 through the relief valve V22 in the end block B1. In addition, the drain fluid tube 60 communicates with the tank T1 through the fluid tube 61 in the control valve V8.

When the pilot fluid flows in the pilot fluid tubes 54A, 54B, 55A, and 55B, a part of the pilot fluid flows into the drain fluid tube 60 through the first throttle 59C or the second throttle 59B, and returns to the tank T1. In this manner, the air present in the pilot fluid tubes 54A, 54B, 55A, and 55B is released.

When the air release circuits 59 are disposed on both of the control valve V1 (the first pilot switch valve D1) and the control valve V4 (the second pilot switch valve D2), a leak amount of the pilot fluid is large. Thus, the pressures in the pilot fluid tubes 54A, 54B, 55A, and 55B are sometimes hard to be increased.

When the pressures in the pilot fluid tubes 54A, 54B, 55A, and 55B are not increased sufficiently, the spools of the direction switch valves D1 and D4 are not pushed sufficiently. Thus, a movement speed of the dozer device 7 is low.

When the air release circuit 59 is disposed on either one of the control valve V1 (the first dozer valve) and the control valve V4 (the second dozer valve), the air in the pilot fluid tubes 54A, 54B, 55A, and 55B can be appropriately released. In addition, the pressures in the pilot fluid tubes 54A, 54B, 55A, and 55B can be increased sufficiently, and the movement speed of the dozer device 7 can be appropriate.

The air release circuit 59 is disposed on the control valve V4 in addition to the air release circuit 59 disposed on either one of the control valve V1 (the first pilot switch valve D1) and the control valve V4 (the second pilot switch valve D2). That is, the air release circuit 59 is disposed on the control valve 4 that is disposed on the downstream portion of the operation fluid flow tube for supplying the operation fluid used for the switching order to switch the direction switch valve D1 and the direction switch valve D4. In this manner, the configuration can release preferably the air present in the upper stream portion of the pilot fluid tubes 54A, 54B, 55A, and 55B. That is, the air releasing can be preferably conducted (the air releasing performance can be assured).

In the embodiment, the air release circuit is disposed on either one of two control valves for the dozer device. However, the configuration is not limited to the control valve for dozer device. That is, in the hydraulic system configured to control an identical hydraulic actuator (a single hydraulic actuator) with a plurality of pilot switch valves operated by the pilot fluid simultaneously, the air release circuit may be disposed to be shared by the plurality of pilot switch valves.

In the embodiment, the first pilot switch valve is disposed on the valve body of the first control valve, and the second pilot switch valve is disposed on the valve body of the second control valve. However, the embodiment is not limited to the configuration. That is, the plurality of pilot switch valves may be installed in one valve body, and the air release circuit may be disposed to be shared by the plurality of pilot switch valves.

Return Circuit of Load Pressure in Load Sensing System

As shown in FIG. 2, FIG. 3, and FIG. 4, a first relief valve V21 is incorporated in the end block V1. A first shuttle valve V14, a second shuttle valve V15, a first unload valve 18, and a second unload valve V19 are incorporated in the valve block B3.

A first switch valve V13, a second switch valve V20, a second relief valve V17, and a first return circuit 66 are incorporated in the valve block B4. A bypass valve V16 is incorporated in the valve block B5. A second return circuit 67 is incorporated in the end block B2.

The control valve CV1 includes a first operation fluid tube 68 and a second operation fluid tube 69. The first operation fluid tube 68 is configured to supply the operation fluid from the first pump port P1. The second operation fluid tube 69 is configured to supply the operation fluid from the second pump port P2. One end of the first operation fluid tube 69 is connected to the input port 18. The first operation fluid tube 68 enters the valve block B4 through the valve block B5 and extends from the valve block B4 to the end block B1 through the control valve V2 and the control valve V1. The other end of the first operation fluid tube 68 is connected to the drain fluid tube 60 in the end block B1.

In addition, the first operation fluid tube 68 is provided with the first relief valve V2 in the end block B1. The first relief valve V21 is a variable relief valve configured to change the set pressure to a first set pressure and to a second set pressure being higher than the first set pressure. In the embodiment, the first relief valve V21 is a variable relief valve configured to be operated by the pilot fluid and thus to change the set pressure by receiving the pilot pressure.

Figure 5:
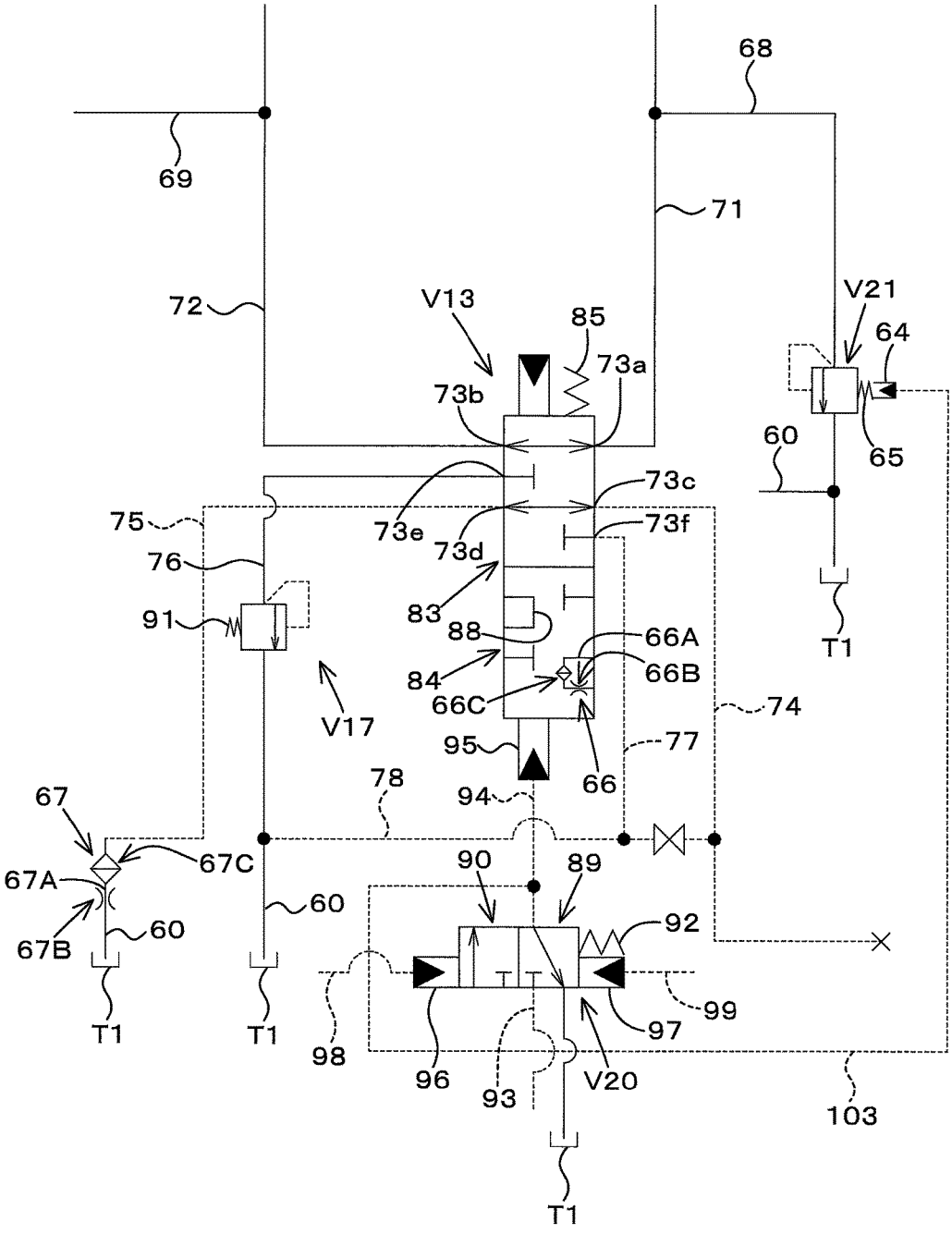
FIG. 5 is a view illustrating a circuit diagram of fluid tubes that shows a confluent position according to the embodiment.
Figure 6:
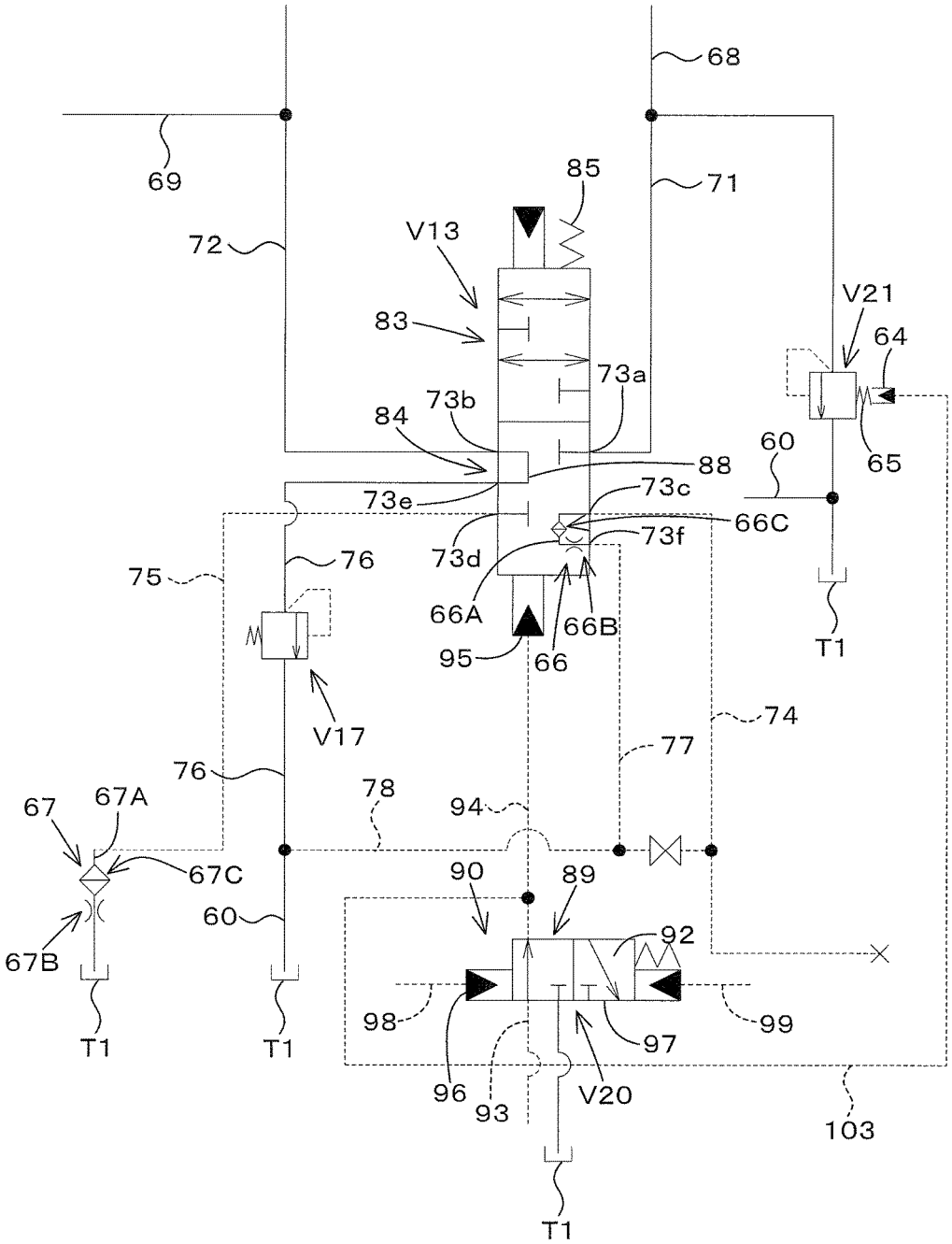
FIG. 6 is a view illustrating a circuit diagram of fluid tubes that shows an isolation position according to the embodiment.

As shown in FIG. 5 and FIG. 6, the first relief valve V21 includes a pressure receiving part 64 and a set spring 65. When the pilot pressure is not applied to the pressure receiving part 64, the first relief valve V21 provides a first set pressure set by the set spring 65. When the pilot pressure is applied to the pressure receiving part 64, the first relief valve V21 provides a second set pressure.

As shown in FIG. 2, FIG. 3, and FIG. 4, the first operation fluid 68 is connected to the direction switch valves D1 and D2 by fluid tubes, and thus the operation fluids are supplied from the first operation fluid tube 68 to the direction switch valves D1 and D2.

One end of the second operation fluid tube 69 is connected to the input port 19. The second operation fluid tube 69 enters the valve block B4 through the valve block B5 and extends from the valve block B4 to the control valve V1 through the control valves V3 to V10. The other end of the second operation fluid tube 69 is closed. The second operation fluid 69 is connected to the direction switch valves D3 to D11 by fluid tubes, and thus the operation fluids are supplied from the second operation fluid tube 69 to the direction switch valves D3 to D11.

The bypass valve V16 is a three-position switch valve having a direct-acting spool that is operated by the pilot pressure. The bypass valve V16 is disposed on a fluid tube 104 and a fluid tube 105. The fluid tube 104 and the fluid tube 105 connects the first operation fluid tube 68 to the second operation fluid tube 69 in parallel.

The bypass valve V16 is configured to be switched to three positions, a block position (a neutral position) 106, a first position 107, and a second position 104. The block position is provided for blocking the pressured fluid to flow in the fluid tube 104 and the fluid tube 105. The first position 107 is provided for allowing the pressure fluid to flow in the fluid tube 104 and blocking the pressure fluid to flow in the fluid tube 105. The second position 104 is provided for blocking the pressure fluid to flow in the fluid tube 104 and allowing the pressure fluid to flow in the fluid tube 105.

The pilot pressure outputted from an operation valve (an operation device) V26 is applied toward a direction to switch the bypass valve V16 from the block position 106 to the first position 107, the operation valve V26 being configured to operate the control valve V3.

In addition, the pilot pressure outputted from an operation valve (an operation device) V27 is applied toward a direction to switch the bypass valve V16 from the block position 106 to the second position 108, the operation valve V26 being configured to operate the control valve V2. When a differential pressure between the pilot pressures of the operation valve V26 and the operation valve V27 is equal to or more than a predetermined pressure, the bypass valve V16 is switched from the block position 106 to the first position 107 or the second position 108 by the pilot pressure on the higher pressure side.

The first operation fluid tube 68 is connected to the first switch valve V13 by a first coupling fluid tube 71. The second operation fluid tube 69 is connected to the first switch valve V13 by a second coupling fluid tube 72.

In addition, the first operation fluid tube 68 is connected to one of the input ports of the first shuttle valve V14 by the signal fluid tube 79. Thus, the operation fluid in the first operation fluid tube 68 is inputted to the first shuttle valve V14.

The second operation fluid tube 69 is connected to the other one of the input ports of the first shuttle valve V14 by the second coupling fluid tube 72 and the signal fluid tube 80. Thus, the operation fluid in the second operation fluid tube 69 is inputted to the first shuttle valve V14. The first shuttle valve V14 outputs from the output port the higher pilot pressure of the pilot pressures inputted to the two input ports (the operation fluid inputted in the opening input port is outputted in a case where the two input ports are in the same pressure).

The output port of the first shuttle valve V14 is connected to the output port. In this manner, the PPS signals (the discharge pressures of the first pump port P1 and the second pump port P2) are outputted from the output port 24.

The signal fluid tube 79 is connected to the first unload valve V18 by the fluid tube 86. The signal fluid tube 80 is connected to the second unload valve V19 by the fluid tube 87.

The unload valve V18 is pressed toward a direction to be closed by a pressing force of a spring, and the pressing force is applied to a direction to close the fluid tube 86. The unload valve V19 is pressed toward a direction to be closed by a pressing force of a spring, and the pressing force is applied to a direction to close the fluid tube 87.

The first switch valve V13 is constituted of a two-position switch valve having a direct-acting spool. In addition, the first switch valve V13 is constituted of a pilot-operation switch valve configured to be switched by the pilot pressure.

As shown in FIG. 5 and FIG. 6, the first switch valve V13 includes six ports 73*a* to 73*f*. The first coupling fluid tube 71 is connected to the port 73*a*. The second coupling fluid tube 72 is connected to the port 73*b*.

One end of the first transmission fluid tube 74 is connected to the port 73*c*. One end of the second transmission fluid tube 75 is connected to the port 73*d*. One end of the relief fluid tube 76 is connected to the port 73*e*. One end of the discharge fluid tube 77 is connected to the port 73*f*.

As shown in FIG. 2 and FIG. 3, the first transmission fluid tube 74 is disposed extending from the valve block B4 to the control valve V1 through the control valve V2. The other end of the first transmission fluid tube 74 is closed. Pressure compensation valves E1 and E2 are connected to the first transmission fluid tube 74 by load transmission fluid tubes Y1 and Y2.

The load transmission fluid tubes Y1 and Y2 transmit the load pressures of the hydraulic actuators (the dozer cylinder C1 and the first travel motor M1) to the first transmission fluid tube 74, the hydraulic actuator being to be controlled by the control valves V1 and V2.

As shown in FIG. 2 and FIG. 4, the second transmission fluid tube 75 is disposed extending from the valve block B4 to the end block B2 through the control valves V3 to V11. The other end of the second transmission fluid tube 75 is connected to the second return circuit 67. The second return circuit 67 is connected to the drain fluid tube 60 in the end block B2.

Pressure compensation valves E3 to E11 are connected to the second transmission fluid tube 75 by load transmission fluid tubes Y3 to Y11. The load transmission fluid tubes Y3 to Y11 transmit the load pressures of the hydraulic actuators (the second travel motor M2, the dozer cylinder C1, the hydraulic attachment, the arm cylinder C4, the bucket cylinder C5, the boom cylinder C3, the turn motor M3, and the swing cylinder C2) to the first transmission fluid tube 74, the hydraulic actuator being to be controlled by the control valves V3 to V11.

The second return circuit 67 includes a connection fluid tube (a second connection fluid tube) 67A, a throttle 67B, and an oil filter 67C. The second connection fluid tube 67A has one end connected to the other end of the second transmission fluid tube 75 and the other end connected to the drain fluid tube 60. The throttle 67B and the oil filter 67C are disposed on the second connection fluid tube 67A. The throttle 67B is disposed on a downstream portion of the oil filter 67C. The second return circuit 67 is a circuit configured to return the pressured fluid in the second transmission fluid tube 75 to the tank T1.

The second relief valve V17 is disposed on the relief fluid tube 76. The second relief valve V17 is a relief valve having a set pressure determined by a set spring 91. The set pressure of the second relief valve V17 is the same as the second set pressure of the first relief valve V21. The other end of the relief fluid tube 76 is connected to the drain fluid tube 60, and communicates with the tank T1.

The other end of the discharge fluid tube 77 is connected to the relief fluid tube 76 by a fluid tube 78. In addition, the other end of the discharge fluid tube 77 is connected downstream than the second relief valve V17 in the relief fluid tube 76. In this manner, the discharge fluid tube 77 communicates with the tank T1.

The first transmission fluid tube 74 is connected to one of the input ports of the second shuttle valve V15 by the signal fluid tube 81. Thus, the pressured fluid of the first transmission fluid tube 74 is inputted to the second shuttle valve V15. The second transmission fluid tube 75 is connected to the other one of the input ports of the second shuttle valve V15 by the signal fluid tube 83. Thus, the pressured fluid of the second transmission fluid tube 75 is inputted to the second shuttle valve V15.

The second shuttle valve V15 outputs from the output port the higher pilot pressure of the pilot pressures inputted to the two input ports (the operation fluid inputted in the opening input port is outputted in a case where the two input ports are in the same pressure). The output port of the second shuttle valve V15 is connected to the output port 23. In this manner, the PLS signals (the highest load pressure of the hydraulic actuator) are outputted from the output port 23.

As shown in FIG. 3, FIG. 5, and FIG. 6, the first switch valve V13 is configured to be switched to the confluent position 83 and the isolation position 84. The first switch valve V13 is pressed toward a direction to be switched to the confluent position 83 by a spring 85.

When the first switch valve V13 is at the confluent position 83 (refer to FIG. 5), the first coupling fluid tube 71 is connected to the second coupling fluid tube 72. That is, the first operation fluid tube 68 and the second operation fluid tube 69 communicate (are connected) with each other through the first coupling fluid tube 71 and the second coupling fluid tube 72. In this manner, the discharge fluid of the first pump port P1 joins the discharge fluid of the second pump port P2, and the joined discharge fluids are supplied to the direction switch valves D1 to D11 of the control valves V1 to V11.

At the confluent position 83, the first transmission fluid tube 74 is connected to the second transmission fluid tube 75. That is, at the confluent position 83, the first switch valve V13 joins the operation fluid of the first pump port P1 with the operation fluid of the second pump port P2 and supplies the joined operation fluids to the first control valve and the second control valve, and then connects the first transmission fluid tube 74 to the second transmission fluid tube 75.

When the first switch valve V13 is at the isolation position 84 (refer to FIG. 6), the connection between the first coupling fluid tube 71 and the second coupling fluid tube 72 is released (that is, disconnected or blocked). That is, the communication between the first operation fluid tube 68 and the second operation fluid tube 69 is released.

In this manner, the discharge fluid of the first pump port P1 is supplied to the direction switch valves D2 and D1 of the control valve (the first travel valve) V2 and the control valve (the first dozer valve) V1. The pressured fluid from the second pump port P2 is supplied to the direction switch valves D3 and D4 of the control valve (the second travel valve) V3 and the control valve (the second dozer valve) V4.

In addition, at the isolation position 84, the pressured fluid from the second pump port P2 is supplied to the direction switch valves D5 to D11 of the control valves V5 to V11.

At the isolation position 84, the connection between the first transmission fluid tube 74 and the second transmission fluid tube 75 is released (that is, disconnected). That is, at the isolation position 84, the operation fluid from the first pump port P1 is supplied exclusively to the first control valve, and the operation fluid from the second pump port P2 is supplied exclusively to the second control valve. In this manner, the communication between the first transmission fluid tube 74 and the second transmission fluid tube 7 is released.

As shown in FIG. 5 and FIG. 6, the first switch valve V13 includes a communication fluid tube 88 and the first return circuit 66. The communication fluid tube 88 connects the port 73*b* to the port 73*e* at the isolation position 84. In this manner, the second coupling fluid tube 72 (the second operation fluid tube 69) is connected to the relief fluid tube 76 at the isolation position 84.

At the confluent position 83, the communication fluid tube 88 is isolated from the port 73*b* and the port 73*e* (isolated from the second coupling fluid tube 72 and the relief fluid tube 76). In this manner, the connection between the port 73*b* and the port 73*e* is released (that is, disconnected), the connection being made by the communication fluid tube 88, and the connection between the second coupling fluid tube 72 (the second operation fluid tube 69) and the relief fluid tube 76 is released (that is, disconnected).

The first return circuit 66 includes a connection fluid tube (the first connection fluid tune) 66A, a throttle 66B, and an oil filter 66C. The throttle 66B and the oil filter 66C are disposed on the first connection fluid tube 66A. The throttle 66B is disposed downstream than the oil filter 66C.

The first connection fluid tube 66A is disposed on a spool of the first switch valve V13, and is constituted of a groove, a hole, and the like formed in the spool.

At the isolation position 84, one end of the first connection fluid tube 66A is connected to the first transmission fluid tube 74 (the port 73*c*), and the other end of the first connection fluid tube 66A is connected to the discharge fluid tube 77 (the port 73*f*). That is, the first connection fluid tube 66A connects the first transmission fluid tube 74 to the discharge fluid tube 77 at the isolation position.

In this manner, at the isolation position 84, the first transmission fluid tube 74 communicates with the tank T1 through the first connection fluid tube 66A, the discharge fluid tube 77, the fluid tube 78, the relief fluid tube 76, the drain fluid tube 60 and the like.

At the confluent position 83, the first connection fluid tube 66A is isolated from the first transmission fluid tube 74 (the port 73*c*) and the discharge fluid tube 77 (the port 73*f*). That is, the first connection fluid tube 66A releases (disconnects) the connection between the first transmission fluid tube 74 and the discharge fluid tube 77 at the confluent position 83.

In other words, the connection between the first transmission fluid tube 74 and the discharge fluid tube 77 is released (that is, disconnected), the connection being made by the first connection fluid tube 66A (the first return circuit 66).

The first return circuit 66 is a circuit configured to be connected to the first transmission fluid tube 74 at the isolation position 84 and to return the pressured fluid of the first transmission fluid tube 74 to the tank T1, and is a circuit configured to release (disconnect) the connection to the first transmission fluid tube 74 at the confluent position 83.

In addition, the second return circuit 67 is a circuit configured to return the pressured fluid of the second transmission fluid tube 75 to the tank T1 at the confluent position 83 and the isolation position 84.

The first return circuit 66 releases (disconnects) the connection to the first transmission fluid tube 74 at the confluent position 83. Thus, when the first transmission fluid tube 74 is connected to the second transmission fluid tube 75, only the second return circuit 67 serves as a return circuit for returning the pressured fluids in the first transmission fluid tube 74 and the second transmission fluid 75 to the tank T1.

Thus, the operation fluids in the first transmission fluid tube 74 and the second transmission fluid tube 75 are not returned too much, and thus the load pressures in the first transmission fluid tube 74 and the second transmission fluid tube 75 are increases preferably.

In this manner, the flow rate control of the discharge fluid of the first pump 27 (the load sensing control) is preferably performed under a state where the first transmission fluid tube 74 is connected to the second transmission fluid tube 75.

In addition, the first return circuit 66 is connected to the first transmission fluid tube 74 at the isolation position 84. Thus, when the communication between the first transmission fluid tube 74 and the second transmission fluid tube 75 is released, the first return circuit 66 returns the pressured fluid of the first transmission fluid tube 74 to the tank T1, and the second return circuit 67 returns the pressured fluid of the second transmission fluid tube 75 to the tank T1.

In this manner, the flow rate control of the discharge fluid of the first pump 27 (the load sensing control) is preferably performed under a state where the first transmission fluid tube 74 is isolated from the second transmission fluid tube 75.

The first return circuit 66 is disposed on the first switch valve V13. In this manner, the configuration of the first return circuit 66 is simplified, and thus the hydraulic system is simplified.

As shown in FIG. 3, FIG. 5, and FIG. 6, the first switch valve V13 is switched by the second switch valve V20. The second switch valve V20 is constituted of a two-position switch valve having a direct-acting spool. In addition, the second switch valve V20 is constituted of a pilot-operation switch valve configured to be switched by the pilot pressure.

The second switch valve V20 includes a release position 89 and a switch position 90. The second switch valve V20 is pressed toward a direction to be switched to the release position 89 by a spring 92. The second switch valve V20 is connected to the input port 22 by the supply fluid tube 93, and supplies the discharge fluid (the pilot fluid) to the second switch valve V20, the discharge fluid being discharged from the second pump 28.

The second switch valve V20 is connected to a pressure receiving part 95 of the first switch valve V13 by the pilot fluid tube 94. The pressure receiving part 95 is a pressure receiver to which a switching pressure (the pilot pressure) to switch the first switch valve V13 to the isolation position 84 is applied.

At the release position 89, the communication between the supply fluid tube 93 and the pilot fluid tube 94 is released (the communication is blocked), and the pilot fluid tube 94 communicates with the tank T1. In this manner, the switching pressure (the pilot fluid) is not outputted from the supply fluid tube 93 at the release position (the pilot pressure is not applied to the pressure receiving part 95), and thus the first switch valve V13 is at the confluent position 83.

In addition, at the switch position 90, the supply fluid tube 93 is connected to the pilot fluid tube 94. Thus, the switching pressure from the supply fluid tube 93 is outputted to the pilot fluid tube 94 at the release position 89. In this manner, the switching pressure is applied to the pressure receiving part 95, and thus the first switch valve V13 is switched to the isolation position 84.

That is, the second switch valve V20 includes the switch position 90 and the release position 89. The switch position 90 is provided for outputting the switching pressure to switch the first switch valve V13 from the confluent position 83 to the isolation position 84. The release position 89 is provided for not outputting the switching pressure.

The second switch valve V20 includes a pressure receiving part 96 and pressure receiving part 97. One end of the pilot fluid tube 98 is connected to the pressure receiving part 96, and one end of the pilot fluid tube 99 is connected to the pressure receiving part 97. As shown in FIG. 3, the other end of the pilot fluid tube 98 is connected to the first detection fluid tube 100 in the end block B1. One end of the first detection fluid tube 100 is connected to the input port 20.

The first detection fluid tube 100 is disposed extending from the end block B1 to the control valve V4. In addition, the first detection fluid tube 100 is disposed extending through the direction switch valve D1, the direction switch valve D2, the direction switch valve D3, and the direction switch valve D4. The other end of the first detection fluid tube 100 is connected to the drain fluid tube 60 by the fluid tube 102 in the control valve V4.

As shown in FIG. 4, the other end of the pilot fluid tube 99 is connected to a second detection fluid tube 101 in the end block B2. In addition, the second detection fluid tube 101 is disposed extending through the direction switch valve D11, the direction switch valve D10, the direction switch valve D9, the direction switch valve D8, the direction switch valve D7, the direction switch valve D6, and the direction switch valve D5. The other end of the second detection fluid tube 101 is connected to the other end of the first detection fluid tube 100 in the control valve V4, and is connected to the drain fluid tube 60 by the fluid tube 102.

When all of the direction switch valves D1 to D11 are at neutral position (when all of the direction switch valves D1 to D11 are not operated), the pilot pressure is not generated in the first detection fluid tube 100, the second detection fluid tube 101, the pilot fluid tube 98 and the pilot fluid tube 99. In that case, the second switch valve V20 is at the release position 89, and the first switch valve V13 is at the confluent position 83 (refer to FIG. 5).

When one of the direction switch valves D1 to D4 (the dozer device 7, the first travel device 3L, and the second travel device 3R) is operated after that condition, an intermediate portion of the first detection fluid tube 100 is blocked. In this manner, the pilot pressure is generated in the pilot fluid tube 98, and thus the second switch valve V20 is switched to the switch position 90. Then, the pilot pressure is applied to the pressure receiving part 95, and thereby the first switch valve V13 is switched to the isolation part 84 (refer to FIG. 6).

When one of the direction switch valves D5 to D11 (the hydraulic attachment, the arm 16, the bucket 17, the boom 15, the turn base 2, and the swing bracket 14) is operated under a state where the first switch valve V13 is switched to the isolation position 84, the intermediate portion of the second detection fluid tube 101 is blocked.

In this manner, the pilot pressure id generated in the pilot fluid tube 99, and then the pilot pressure corresponding to the pilot pressure of the pilot fluid tube 98 is applied to the pressure receiving part 97. Thus, the second switch valve V20 is switched to the release position 89, and the first switch valve V13 is switched to the confluent position 83.

Meanwhile, even when one of the direction switch valves D5 to D11 is operated without the operations of the direction switch valves D1 to D4, the first switch valve V13 is at the confluent position 83.

As described above, in the hydraulic system, the first switch valve V13 is at the confluent position in the operation of the operation device 4. In addition, the first switch valve V13 is switched to the isolation position 84 in the operation of at least one of the first travel device 3L and the second travel device 3R, that is, in the operation of the travel device 3 without the operation of the operation device 4.

Meanwhile, the frat switch valve V13 may be configured to be at the isolation position 84 in the operation of the operation device 4 and to be at the confluent position 83 in the operation of the travel device 3.

Switching of Set Pressure of Relief Valve

As shown in FIG. 3, FIG. 5, and FIG. 6, one end of the switch fluid tube 103 is connected to the pilot fluid tube 94. The other end of the switch fluid tube 103 is connected to the pressure receiving part 64 of the first relief valve V21. When the pilot pressure is not applied to the pilot fluid tube 94, the pilot pressure is not applied to the switch fluid tube 103 and the pressure receiving part 64. Thus, the set pressure of the first relief valve V21 is the first set pressure.

When the pilot pressure is applied to the pilot fluid tube 94, the pilot pressure is applied to the switch fluid tube 103 and the pressure receiving part 64, and then the set pressure is changed to the second set pressure. That is, the first relief valve V21 is a variable relief valve configured to be switched to the second set pressure by the switching pressure outputted from the second switch valve V20.

As shown in FIG. 5, the connection between the second coupling fluid tube 72 (the second operation fluid tube 69) and the relief fluid tube 76 is released at the confluent position 83 (one end of the relief fluid tube 76 is closed), and thus the second relief valve V17 does not set the circuit pressure of the second operation fluid tube 69. The second relief valve V17 does not serve as a relief valve configured to set the circuit pressure of the second operation fluid tube 69

In addition, the first operation fluid tube 68 communicates with the second operation fluid tube 69, and the first relief valve V2 is disposed on the first operation fluid tube 68. In that case, the first relief valve V21 sets the circuit pressures of the first operation fluid tube 68 and the second operation fluid tube 69 (the circuit pressure of the discharge circuit of the first pump 27). In addition, the set pressure of the first relief valve V21 is the first set pressure.

That is, in the operation of the operation device 4, the circuit pressures of the first operation fluid tube 68 and the second operation fluid tube 69 are the first set pressure of the first relief valve V21. In the operations of the turn base 2, the swing bracket 14, and the hydraulic attachment, the circuit pressure is the first set pressure.

as shown in FIG. 6, at the isolation position 84, the second operation fluid tube 69 is connected to the relief fluid tube 76 by the second coupling fluid tube 72 and the communication fluid tube 88. In that case, the second relief valve V17 serves as a relief valve configured to set the circuit pressure of the second operation fluid tube 69 (the circuit pressure of the discharge circuit of the second pump port P2).

In addition, at the isolation position 84, the first relief valve V21 serves as the relief valve configured to set the circuit pressure of the first operation fluid tube 68. The set pressure of the first relief valve V21 is set to the second set pressure being higher than the first set pressure.

In addition, the set pressure of the second relief valve V17 is the same as the second set pressure. That is, the circuit pressure is set to a set pressure higher than the set pressure used for operating the operating device 4 when only the ravel device 3 is in operation. The circuit pressure is also set to a set pressure higher than the set pressure used for operating the operating device 4 when only the dozer device 7 is in operation and when only the travel device 3 and the dozer device 7 are in operation.

As described above, the first relief valve V21 is a relief valve configured to set the circuit pressures of the first operation fluid tube 68 and the second operation fluid tube 69 to the first set pressure at the confluent position 83, and is a variable relief valve configured to set the circuit pressure of the first operation fluid tube 68 to the second set pressure being higher than the first set pressure at the isolation position 84.

In addition, the second relief valve V17 is a relief valve configured to set the circuit pressure of the second operation fluid tube 69 to the set pressure equivalent to the second set pressure, and to release the setting of the circuit pressure of the second operation fluid tube 69 at the confluent position 83.

In order to maintain a trail power of the travel device, the conventional work machine includes a relief valve for a first travel device and a relief valve for a second travel device other than the relief valve use for operating an operation device. That is, the conventional work machine includes three relief valves. However, hydraulic hoses are arranged centrally around the control valve, and thus the space for hose arrangement is requested to be as large as possible. In addition, the number of components is requested to be reduced to reduce the costs for the hydraulic machine.

In the embodiment, the first relief valve V21 works but the second relief valve V17 does not work in the operation of the operation device 4, and the first relief valve V21 and the second relief valve V17 both work in the operation of the travel devices 3L and 3R without operation of the operation device 4.

The first relief valve V21 is used both in the operation of the operation device 4 and in the operation of the travel devices 3L and 3R without operation of the operation device 4. Meanwhile, the first relief valve V21 changes the set pressure to be different in the operation of the operation device 4 and in the operation of the travel devices 3L and 3R without operation of the operation device 4. In this manner, the number of the relief valves can be reduced, and thus the control valve CV1 can be formed compactly.

When the control valve CV1 is formed compactly, a large space for hose arrangement can be provided. In addition, the reduction of the number of components allows the control valve CV1 to be manufactured in low cost. And, a traveling trail power for a heavy work machine can be obtained even in a case the hydraulic system is employed in work machines having different weights.

Meanwhile, in the hydraulic circuit shown in the drawings, the pilot pressure to switch the first relief valve V21 is taken out from the pilot fluid tube 94. However, the embodiment is not limited to the configuration. It is required for the first relief valve V21 to be changed to the second set pressure in a case where the first switch valve V13 is switched to the isolation position 84.

For example, the pilot pressures outputted from the operation valve V27 and the operation valve V26 may be applied to the first relief valve V21, the operation valve V27 being configured to operate the control valve V2, the operation valve V26 being configured to operate the control valve V3. In this manner, the set pressure of the first relief valve V21 may be changed.

In addition, the first relief valve V21 may be electrically switched to change the set pressure by an electromagnetic valve. And, the set pressure of the first relief valve V21 may be switched by the pilot pressure from the electromagnetic valve.

Return Path of Return Fluid of Hydraulic Actuator

Figure 7:
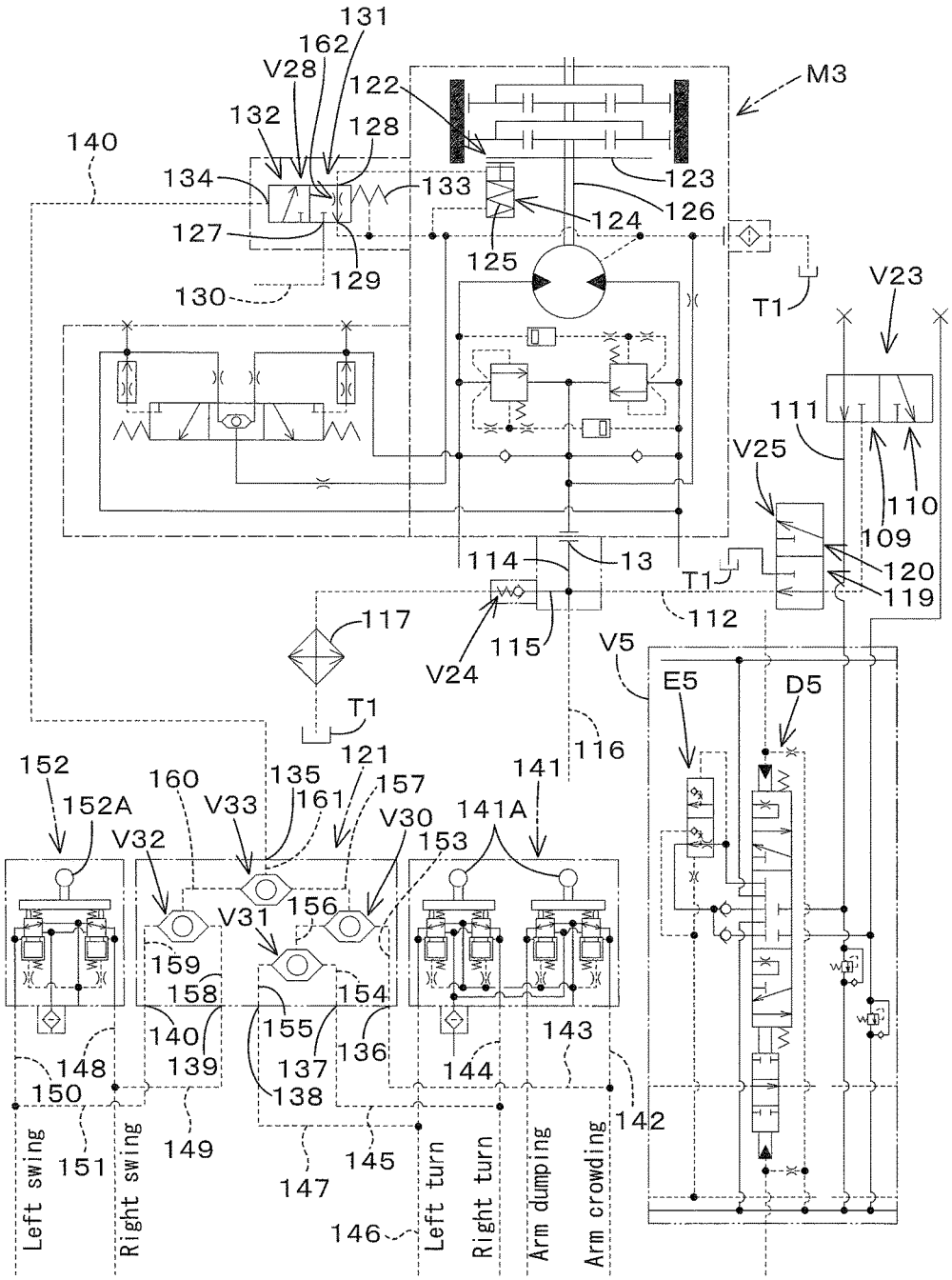
FIG. 7 is a view illustrating a circuit diagram of fluid tubes that shows a part of the hydraulic system according to the embodiment.

As shown in FIG. 7, the hydraulic system includes a line switch valve V23. The line switch valve V23 is a two-position switch valve configured to be switched to a first switch position 109 and a second switch position 110.

The first switch position 109 is a position to return a return fluid to the control valve V5, the return fluid returning from the actuator connected to the control valve V5. The second switch position 110 is a position to allow a return fluid to return to the tank T1 without passage through the control valve V5, the return fluid returning from the actuator connected to the control valve V5.

A return fluid tube (a first return fluid tube) 111 and a return fluid tube (a second return fluid tube) 112 are connected to the line switch valve V23. The first return fluid tube 111 is a fluid tube configured to return the return fluid from the hydraulic actuator to the control valve V5.

The second return fluid tube 112 is a fluid tube configured to return the return fluid from the hydraulic actuator to the tank T1 without passage through the control valve V5. The second return fluid tube 112 is connected to a fluid tube 114. The fluid tube 114 is connected to the discharge port (a makeup port) 113 of the turn motor M3. The return fluid tube (the third return fluid tube) 115 and the return fluid tube (the fourth return fluid tube) 116 are connected to the fluid tube 114.

The third return fluid tube 115 communicates with the tank T1 through the oil cooler 117. The third return tube 115 includes a check valve V24. As shown in FIG. 4, the fourth return fluid tube 116 is connected to a tank port 118. The tank port 118 is disposed on the control valve V8. The tank port 118 communicates with a drain fluid tube 60.

In a case where the return fluid from the hydraulic actuator is returned to the tank T1 without passage through the control valve V5, the return fluid directly returns to the tank T1. In that case, the heat balance may be deteriorated. In the case where the return fluid from the hydraulic actuator is returned to the tank T1 without passage through the control valve V5, the return fluid is returned to the tank T1 through the oil cooler 117, thereby preventing the deterioration of the heat balance.

In addition, the second return fluid tube 112 is connected to the turn motor M3, and thereby a hydraulic hose serving as the second return fluid tube 112 is laid on a broad space between the turn motor M3 and the control valve CV1. In this manner, the hydraulic hose is prevented from being hit to peripheral components and damaged, the hitting being caused because of pulsations and vibrations of the hydraulic hose under a state where the breaker and the like is used Meanwhile, a selection valve V25 may be disposed on the second return fluid tube 112. The selection valve V25 is a two-position switch valve configured to be switched to a first position 119 and to a second position 120. The first position 119 is provided for supplying the return fluid of the hydraulic actuator to the third return fluid tube 115. The second position 120 is provided for returning the return fluid of the hydraulic actuator directly to the tank T1 (without passage through the oil cooler 117).

Brake Release Circuit of Turn Brake

As shown in FIG. 7, the hydraulic system includes a brake release circuit 121. The brake release circuit 121 is a circuit configured to output the pilot pressure to the brake switch valve V28. The pilot pressure is used for releasing the turn brake 112 disposed on the turn motor M3.

The turn brake 112 is a negative brake, and includes a brake disc 123, a brake cylinder (a hydraulic cylinder) 124, and a brake spring 125. The brake disk 123 is disposed on an output shaft 126 of the turn motor M3. The brake disc 123 is capable of turning integrally with the output shaft 126. The brake cylinder 124 is stretched to press the brake disc 123 and thereby brakes the turn motor M3.

In addition, the brake cylinder 124 is shortened to release the pressing to the brake disc 123, and thereby releases the braking to the turn motor M3. The brake spring 125 is incorporated in the brake cylinder 124, and pushes the brake cylinder 124 toward a direction of stretching. The brake cylinder 124 is shortened by the hydraulic pressure.

The brake switch valve V28 includes a port 127, a port 128, and a port 129. As shown in FIG. 1, the port 127 is connected to the output port 32 by the supply fluid tube 130, the supply fluid tube 40, and the supply fluid tube 38.

Thus, the pilot pressure (the pilot fluid) is supplied to the port 127. The pilot pressure (the pilot fluid) is discharged from the second pump 28. The port 128 communicates with a rod side of the brake cylinder 124. The port 129 communicates with the tank T1.

The brake switch valve V28 includes a brake position 131 and a release position 132. The brake position 131 is a position provided for connecting the port 128 to the port 129 and thereby releasing the hydraulic pressure from the brake cylinder 124. That is, the brake position 131 is a position to activate the turn brake 122. The release position 132 is a position provided for connecting the port 127 to the port 128 and thereby supplying the hydraulic pressure to the brake cylinder 124. That is, the release position 132 is a position to release the turn brake 122.

The turn brake 122 has a delay function to maintain a state of releasing the brake for a few seconds before shifting from the state of releasing the brake to a state of activating the brake. The delay function is constituted of a throttle 162, for example. The throttle 162 is disposed on a flow tube to release the hydraulic pressure from the brake cylinder 124 at the brake position 131.

In this manner, the throttle 162 delays the pressure releasing from the brake cylinder 124 in the switching of the brake switch valve V28 from the release position 132 to the brake position 131 (in switching the turn brake 122 from the released state to the activated state). In this manner, the turn brake 122 holds the state of releasing the brake for a few seconds.

In addition, the brake switch valve V28 is pushed toward a direction to be switched to the brake position 131 by a spring 133, and is switched to the release position 132 by the pilot pressure applied to a pressure receiving port 134.

The brake release circuit 121 includes a single output port 135, five input ports 136 to 140, and four shuttle valves V30 to V33. The output port 135 is connected to the pressure receiving port 134 by the pilot fluid tube 140.

The pilot pressure is inputted from the remote control valve (the operation device) 141 to the input ports 136 to 139. The pilot pressure is inputted from the remote control valve (the operation device) 152 to the input port 140.

The remote control valve 141 is a device configured to operate the control valve V9 (the turn base 2) and the control valve V6 (the arm 16). The remote control valve 141 includes an operation lever 141A. When the operation lever 141A is swung forward, the pilot pressure is outputted to the control valve V6 such that the arm 16 performs the dumping operation (is swung upward or toward a direction separating away from the turn base 2).

When the operation lever 141A is swung backward, the pilot pressure is outputted to the control valve V6 through the pilot fluid tube 142 such that the arm 16 performs the crowding operation (is swung downward or toward a direction approaching the turn base 2). When the operation lever 141A is swung rightward, the pilot pressure is outputted to the control valve V9 through the pilot fluid tube 144 such that the turn base 2 turns rightward. When the operation lever 141A is swung leftward, the pilot pressure is outputted to the control valve V6 through the pilot fluid tube 146 such that the turn base 2 turns leftward.

The input port 136 is connected to the pilot fluid tube 142 by the pilot fluid tube 143. The input port 137 is connected to the pilot fluid tube 144 by the pilot fluid tube 145. The input port 138 is connected to the pilot fluid tube 146 by the pilot fluid tube 147.

The remote control valve 152 is a device configured to operate the control valve V11 (the swing bracket 14). The remote control valve 152 includes an operation lever 152A. When the operation lever 152A is swung rightward, the pilot pressure is outputted to the control valve V11 through the pilot fluid tube 148 such that the swing bracket 14 swings rightward. When the operation lever 152A is swung leftward, the pilot pressure is outputted to the control valve V11 through the pilot fluid tube 150 such that the swing bracket 14 swings leftward.

The input port 139 is connected to the pilot fluid tube 148 by the pilot fluid tube 149. The input port 140 is connected to the pilot fluid tube 150 by the pilot fluid tube 151.

Each of the shuttle valves V30 to V33 includes two input ports and one output port, and outputs from the output port the higher pilot pressure of the pilot pressures inputted to the two input ports (the operation fluid inputted in the opening input port is outputted in a case where the two input ports are in the same pressure).

One of the input ports of the shuttle valve V30 is connected to the input port 136 by the pilot fluid tube 153. The other one of the input ports of the shuttle valve V30 is connected to the output port of the shuttle valve V31 by the pilot fluid tube 156.

The output port of the shuttle valve V30 is connected to one of the input ports of the shuttle valve V33 by the pilot fluid tube 157. One of the input ports of the shuttle valve V31 is connected to the input port 137 by the pilot fluid tube 154. The other one of the input ports of the shuttle valve V31 is connected to the input port 138 by the pilot fluid tube 155.

One of the input ports of the shuttle valve V32 is connected to the input port 139 by the pilot fluid tube 158. The other one of the input ports of the shuttle valve V32 is connected to the input port 140 by the pilot fluid tube 159. The output port of the shuttle valve V32 is connected to the other one of the input ports of the shuttle valve V33 by the pilot fluid tube 160.

As described above, the turn brake 122 is activated when the turn base 2 is not in the turning operation, the arm 16 is not in the crowding operation, and the swing bracket 14 is not in the swinging operation. In addition, the turn brake 122 is released when at least one of the turn base 2, the arm 16, and the swing bracket 14 is in operation.

The turn bearing 8 includes an outer lace and an inner lace. The outer lace is fixed to a frame of the travel device 3. The inner lace is fixed to the turn base 2. An internal gear is formed on an inner circumference of the inner lace. The turn motor M3 includes a pinion engaged with the internal gear of the turn bearing 8, and the driving of the pinion turns the turn base 2.

When the swing bracket 14 is swung, a force is applied to the engagement portion between the internal gear and the pinion under a state where the turn brake 122 is activated. In the embodiment, the turn brake 122 is released in a case where the swing bracket 14 is operated, and thus the force applied to the engagement portion between the internal gear and the pinion can be released.

In addition, the operation device 4 is disposed by being offset from the center of the turn base 2 toward one end (the right end). In this manner, also in a case where the arm 16 is in the crowding operation (in a shoveling operation), a force is applied to the engagement portion between the internal gear and the pinion when the turn brake 122 is activated, and thus the turn brake 122 is released.

In a case where a large moment generates in the operation of the swing bracket 14 (for example, a case where soil is piled up in the bucket 17 and a case where the boom 15 and the arm 16 are stretched forward), a large force is applied to the engagement portion between the internal gear and the pinion when the swinging of the swing bracket 14 is suddenly stops under a state where the turn brake 122 is activated. In that case, the force applied to the engagement portion between the internal gear and the pinion can be released.

That is, when the operation of the swing bracket 14 is stopped, the turn brake 122 is switched from the released state to the activated state. However, the turn brake 122 is in the released state for a few seconds in the switching of the turn brake 122 from the released state to the activated state, and thus the force applied to the engagement portion between the internal gear and the pinion can be released.

Effectiveness

A hydraulic system for a work machine according to the embodiment includes the first control valves V1 and V2 to control the first hydraulic actuator, the second control valves V3 to V11 to control the second hydraulic actuator, the tank T1 to store the operation fluid, a first operation fluid tube 68 to supply the operation fluid to the first control valves V1 and V2, a second operation fluid tube 69 to supply the operation fluid to the second control valves V3 to V11, a first transmission fluid tube 74 to transmit a load pressure of the first hydraulic actuator controlled by the first control valves V1 and V2, a second transmission fluid tube 75 to transmit a load pressure of the second hydraulic actuator controlled by the second control valves V3 to V11, a first switch valve V13 having a confluent position 83 to connect the first operation fluid tube 68 to the second operation fluid tube 69 and to connect the first transmission fluid tube 74 to the second transmission fluid tube 75, and an isolation position 84 to release the connection between the first operation fluid tube 74 and the second operation fluid tube 75 and to release the connection between the first transmission fluid tube 74 and the second transmission fluid tube 75, the first switch valve V13 being configured to be switched to the confluent position 83 and to the isolation position 84, a first return circuit 66 configured to be connected to the first transmission fluid tube 74 and to return the operation fluid in the first transmission fluid tube 74 to the tank T1 at the isolation position 84 and configured to release the connection to the first transmission fluid tube 74 at the confluent position 83, and a second return circuit 67 to return the operation fluid in the second transmission fluid tube 75 at the confluent position 83 and the isolation position 84.

According to the hydraulic system for the work machine mentioned above, the first return circuit 66 releases the connection to the first transmission fluid tube 74 at the confluent position 83. Thus, when the first transmission fluid tube 74 is connected to the second transmission fluid tube 75, only the second return circuit 67 serves as a return circuit for returning the operation fluids in the first transmission fluid tube 74 and the second transmission fluid 75 to the tank T1.

In this manner, the operation fluids in the first transmission fluid tube 74 and the second transmission fluid tube 75 are not returned too much, and thus the load pressures in the first transmission fluid tube 74 and the second transmission fluid tube 75 are increases preferably.

The hydraulic system for the work machine may include the first pump port P1 to discharge the operation fluid to the first operation fluid tube, the second pump port P2 to discharge the operation fluid to the second operation fluid tube, and the controller to control a flow rate of the operation fluid based on a discharge pressure of the first pump port P1 or the second pump port P2 and on a load pressure of the first transmission fluid tube 74 or the second transmission fluid tube 75, the operation fluid being discharged from the first pump port P1 and the second pump port P2.

According to the hydraulic system for the work machine mentioned above, the first return circuit 66 releases the connection to the first transmission fluid tube 74 at the confluent position 83. Thus, when the first transmission fluid tube 74 is connected to the second transmission fluid tube 75, only the second return circuit 67 serves as a return circuit for returning the operation fluids in the first transmission fluid tube 74 and the second transmission fluid 75 to the tank T1.

In this manner, the operation fluids in the first transmission fluid tube 74 and the second transmission fluid tube 75 are not returned too much to the tank T1, and thus the load pressures in the first transmission fluid tube 74 and the second transmission fluid tube 75 are increases preferably. Since the load pressures in the first transmission fluid tube 74 and the second transmission fluid tube 75 are increases preferably, a flow rate of the operation fluid to be discharged from the first pump port P1 and the second pump port P2 can be controlled preferably under a state where the first transmission fluid tube 74 is connected to the second transmission fluid tube 75.

In addition, the first return circuit 66 is disposed on the first switch valve V13. In this manner, the hydraulic system (the hydraulic circuit) can be simplified.

The hydraulic system for the work machine includes the discharge fluid tube 77 to communicate with the tank T1. The first return circuit 66 includes the connection fluid tube 66A configured to connect the first transmission fluid tube 74 to the discharge fluid tube 77 at the isolation position 84 and to release the connection between the first transmission fluid tube 74 and the discharge fluid tube 77 at the confluent position 83, and the throttle 66B disposed in the connection fluid tube 66A. In this manner, the first return circuit 66 can be configured simply, and the hydraulic system (the hydraulic circuit) can be simplified.

The hydraulic system for the work machine includes the operation device 4 including the boom cylinder C3 to move the boom 15, the arm cylinder C4 to move the arm 16, and the operation tool cylinder C5 to move the operation tool 17, the travel device 3 including the first travel device 3L to be driven by the first travel motor M1 and the second travel device 3R to be driven by the second travel motor M2, the boom valve V8 to control the boom cylinder C3, the arm valve V6 to control the arm cylinder C4, the operation tool valve V7 to control the operation tool, the first travel valve V2 to control the first travel motor M1, the first travel valve V2 being included in the first control valve V1, and the second travel valve V3 to control the second travel motor M2, the second travel valve V3 being included in the second control valve V2. The first control valves V1 and V2 include the first travel valve V2. The second control valves V3 to V11 include the second travel valve V3. The boom valve V8, the arm valve V6, and the operation tool valve V7 are included in any one of the first control valves V1 and V2 and the second control valves V3 to V11. The first switch valve V13 is switched to the confluent position 83 when at least one of the boom valve V8, the arm valve V6, and the operation tool valve V7 are operated, and is switched to the isolation position 84 when at least one of the first travel valve V2 and the second travel valve V3 are operated in driving the travel device 3 without movement of the operation device 4.

In this manner, the load pressures in the first transmission fluid tube 74 and the second transmission fluid tube 75 are increases preferably. Thus, a flow rate of the operation fluid to be discharged from the first pump port P1 and the second pump port P2 can be controlled preferably in an operation, and operability can be improved.

The hydraulic system for the work machine includes the first relief valve V21 configured to set circuit pressures in the first operation fluid tube 68 and the second operation fluid tube 69 to a first set pressure at the confluent position 83 and to set the circuit pressure in the first operation fluid tube 68 to a second set pressure higher than the first set pressure at the isolation position 84, and the second relief valve V17 configured to set the circuit pressure in the second operation fluid tube 69 to a set pressure equivalent to the second set pressure at the isolation position 84 and to release the setting of the circuit pressure in the second operation fluid tube 69 at the confluent position 83.

In this manner, the first relief valve V21 serves as the relief valve to set circuit pressures in the first operation fluid tube 68 and the second operation fluid tube 69 at the confluent position 83 and as the relief valve to set the circuit pressure in the first operation fluid tube 68 at the isolation position 84, and thus the number of the relief valves can be reduced.

The hydraulic system for the work machine includes a second switch valve including the switch position 90 to output a switching pressure for switching the first switch valve V13 from the confluent position 83 to the isolation position 84 and the release position 89 not to output the switching pressure. The first relief valve V21 is a variable relief valve configured to switch the circuit pressure in the first operation fluid tube 68 to the second set pressure by receiving the switching pressure outputted from the second switch valve. The switch pressure outputted from the second switch valve is used as a pressure to switch the first relief valve V21 to the second set pressure, and thus the hydraulic system (the hydraulic circuit) can be simplified.

The hydraulic system for the work machine includes the relief fluid tube 76 including the second relief valve V17. The first switch valve V13 includes the communication fluid tube 88 configured to connect the second operation fluid tube 69 to the relief fluid tube 76 at the isolation position 84 and to release the connection between the second operation fluid tube 69 and the relief fluid tube 76 at the confluence position 83.

In other words, the communication fluid tube 88 is disposed on the first switch valve V13. The communication fluid tube 88 is configured to switch the second relief valve V17 to be in-use or not in-use. In this manner, the hydraulic system (the hydraulic circuit) can be simplified.

In addition, the hydraulic system for the work machine according to the embodiment includes the tank T1 to store the operation fluid, the hydraulic actuator C1, the plurality of pilot pressure switch valves D1 and D4 to control the hydraulic actuator C1 to be driven by the operation fluid, the operation device 56 configured to operate the plurality of pilot pressure switch valves D1 and D4 by using the operation fluid, and an air release circuit 59 configured to return a part of the operation fluid to the tank T1, the operation fluid being used for operating the plurality of pilot pressure switch valves D1 and D4, and shared by the plurality of pilot pressure switch valves D1 and D4.

In this manner, a leak amount of the pilot pressure from the air release circuit 59 can be appropriate, and the pilot circuit 53 can be pressured sufficiently, the pilot circuit 53 being configured to supply the operation fluid to the plurality of pilot pressure switch valves D1 and D4. As the result, stability of the operation of the hydraulic actuator C1 can be improved.

In addition, of the plurality of pilot pressure switch valves D1 and D4, the air release circuit 59 is disposed on the pilot pressure switch valves D4. The pilot pressure switch valves D4 is disposed on the downstream portion of the operation fluid flow tube for supplying the operation fluid supplied from the operation device 56.

In this manner, the configuration can release preferably the air present in the upper stream portion of the operation fluid flow tube for supplying the operation fluid supplied from the operation device 56, that is, can conduct the air releasing preferably (can assure the air releasing performance).

In addition, the plurality of pilot pressure switch valves D1 and D4 includes the first pilot pressure switch valve D1 and the second pilot pressure switch valve D4. The air release circuit 59 is disposed on one of the first pilot pressure switch valve D1 and the second pilot pressure switch valve D4.

In this manner, a leak amount of the pilot pressure from the air release circuit 59 can be appropriate, and the pilot circuit 53 can be pressured sufficiently, the pilot circuit 53 being configured to supply the operation fluid to the plurality of pilot pressure switch valves D1 and D4. As the result, stability of the operation of the hydraulic actuator C1 can be improved.

In addition, the hydraulic system for the work machine includes the pilot circuit 53 including the first supply circuit 54 and the second supply circuit 55. The first supply circuit 54 is configured to supply the operation fluid from the operation device 56 to one of the first pilot pressure switch valve D1 and the second pilot pressure switch valve D4. The second supply circuit 55 is configured to supply the operation fluid from the first supply circuit 54 to the other one of the first pilot pressure switch valve D1 and the second pilot pressure switch valve D4. The air release circuit 59 is connected to the second supply circuit 55. In this manner, the configuration can release preferably the air present in the first supply circuit 54 disposed on an upper stream portion in the pilot circuit 53.

In addition, the hydraulic system for the work machine includes the dozer device 7. The hydraulic actuator C1 is the dozer cylinder configured to move the dozer device 7. In this manner, stability of the operation of the dozer device 7 can be improved.

According to the hydraulic system for the work machine of the embodiment mentioned above, the first return circuit 66 releases the connection to the first transmission fluid tube 74 at the confluent position 83. Thus, when the first transmission fluid tube 74 is connected to the second transmission fluid tube 75, only the second return circuit 67 serves as a return circuit for returning the operation fluids in the first transmission fluid tube 74 and the second transmission fluid 75 to the tank T1.

In this manner, the operation fluids in the first transmission fluid tube 74 and the second transmission fluid tube 75 are not returned too much to the tank T1, and thus the load pressures in the first transmission fluid tube 74 and the second transmission fluid tube 75 are increases preferably.

In the above description, the embodiment of the present invention has been explained. However, all the features of the embodiment disclosed in this application should be considered just as examples, and the embodiment does not restrict a scope of the present invention accordingly. The scope of the present invention is shown not in the above-described embodiment but in claims, and is intended to include all modifications within and equivalent to a scope of the claims.

Obviously, numerous modifications and variations of the present invention are possible in light of the above teachings. It is therefore to be understood that within the scope of the appended claims, the invention may be practiced otherwise than as specifically described herein.

What is claimed is:

1. A hydraulic system for a work machine comprising:

a first control valve to control a first hydraulic actuator;

a second control valve to control a second hydraulic actuator;

a tank to store an operation fluid;

a first operation fluid tube through which the operation fluid is to be supplied to the first control valve;

a second operation fluid tube through which the operation fluid is to be supplied to the second control valve;

a first transmission fluid tube through which a load pressure of the first hydraulic actuator controlled by the first control valve is to be transmitted;

a second transmission fluid tube through which a load pressure of the second hydraulic actuator controlled by the second control valve is to be transmitted;

a first switch valve switchable between a confluent position and an isolation position, the first switch valve being switched to the confluent position such that the first operation fluid tube is connected to the second operation fluid tube and the first transmission fluid tube is connected to the second transmission fluid tube, the first switch valve being switched to the isolation position such that the first operation fluid tube is disconnected from the second operation fluid tube and the first transmission fluid tube is disconnected from the second transmission fluid tube;

a first return circuit to be connected to the first transmission fluid tube such that the operation fluid in the first transmission fluid tube is to be returned to the tank through the first return circuit when the first switch valve is switched to the isolation position, the first return circuit being to be disconnected from the first transmission fluid tube when the first switch valve is switched to the confluent position; and a second return circuit through which the operation fluid in the second transmission fluid tube is returned to the tank when the first switch valve is switched to one of the confluent position and the isolation position.

2. The hydraulic system according to claim 1, comprising:

a first pump port through which the operation fluid is to be supplied to the first operation fluid tube;

a second pump port through which the operation fluid is to be supplied to the second operation fluid tube; and a controller to control a flow rate of the operation fluid to be supplied from the first pump port and the second pump port based on a pressure of the operation fluid supplied from the first pump port or the second pump port and on a load pressure of the operation fluid supplied through the first transmission fluid tube or the second transmission fluid tube.

3. The hydraulic system according to claim 1, wherein the first return circuit is disposed in the first switch valve.

4. The hydraulic system according to claim 1, comprising:

a discharge fluid tube communicating with the tank, wherein the first return circuit includes a connection fluid tube to connect the first transmission fluid tube to the discharge fluid tube when the first switch valve is switched to the isolation position and to disconnect the first transmission fluid tube from the discharge fluid tube when the first switch valve is switched to the confluent position, and a throttle disposed in the connection fluid tube.

5. The hydraulic system according to claim 1, comprising:

an operation device comprising:

a boom cylinder to move a boom;

an arm cylinder to move an arm; and an operation tool cylinder to move an operation tool;

a travel device comprising:

a first travel device to be driven by a first travel motor; and a second travel device to be driven by a second travel motor;

a boom valve to control the boom cylinder;

an arm valve to control the arm cylinder;

an operation tool valve to control the operation tool;

a first travel valve to control the first travel motor, the first control valve including the first travel valve; and a second travel valve to control the second travel motor, the second control valve including the second travel valve, wherein the boom valve, the arm valve, and the operation tool valve are included in the first control valve or the second control valve, wherein the first switch valve is switched to the confluent position when at least one of the boom valve, the arm valve, and the operation tool valve is operated, and wherein the first switch valve is switched to the isolation position when at least one of the first travel valve and the second travel valve is operated when the travel device is driven without movement of the operation device.

6. The hydraulic system according to claim 1, comprising:

a first relief valve to set circuit pressures in the first operation fluid tube and the second operation fluid tube to a first set pressure when the first switch valve is switched to the confluent position and to set the circuit pressure in the first operation fluid tube to a second set pressure higher than the first set pressure when the first switch valve is switched to the isolation position; and a second relief valve to set the circuit pressure in the second operation fluid tube to the second set pressure when the first switch valve is switched to the isolation position and to release the setting of the circuit pressure in the second operation fluid tube when the first switch valve is switched to the confluent position.

7. The hydraulic system according to claim 6, comprising:

a second switch valve switchable between a switch position and a release position, the second switch valve being switched to the switch position such that a switching pressure of the operation fluid to switch the first switch valve from the confluent position to the isolation position is outputted, the second switch valve being switched to the release position such that the switching pressure is not outputted, wherein the first relief valve is a variable relief valve to receive the switching pressure outputted from the second switch valve to switch the circuit pressure in the first operation fluid tube to the second set pressure.

8. The hydraulic system according to claim 6, comprising:

a relief fluid tube including the second relief valve, wherein the first switch valve includes a communication fluid tube to connect the second operation fluid tube to the relief fluid tube when the first switch valve is switched to the isolation position and to disconnect the second operation fluid tube from the relief fluid tube when the first switch valve is switched to the confluence position.

9. A hydraulic system for a work machine, comprising:

a tank to store an operation fluid;

a hydraulic actuator to be driven using the operation fluid;

a plurality of pilot switch valves to control the hydraulic actuator;

an operation device to operate the plurality of pilot switch valves using the operation fluid; and an air release circuit through which a part of the operation fluid used for operating the plurality of pilot switch valve is to be returned to the tank, the air release circuit being shared by the plurality of pilot switch valves, the air release circuit being provided for one of the plurality of pilot switch valves, the one of the plurality of pilot switch valves being disposed on a downstream portion of an operation fluid tube through which the operation fluid supplied from the operation device is to flow.

10. A hydraulic system for a work machine, comprising:

a tank to store an operation fluid;

a hydraulic actuator to be driven using the operation fluid;

a plurality of pilot switch valves to control the hydraulic actuator, the plurality of pilot switch valves including:

a first pilot switch valve, and a second pilot switch valve;

an operation device to operate the plurality of pilot switch valves using the operation fluid; and an air release circuit through which a part of the operation fluid used for operating the plurality of pilot switch valve is to be returned to the tank, the air release circuit being shared by the plurality of pilot switch valves, the air release circuit being provided to one of the first pilot switch valve and the second pilot switch valve.

11. The hydraulic system according to claim 10, comprising:

a pilot circuit comprising:

a first supply circuit to supply the operation fluid from the operation device to one of the first pilot switch valve and the second pilot switch valve; and a second supply circuit to supply the operation fluid from the first supply circuit to another of the first pilot switch valve and the second pilot switch valve, the air release circuit being connected to the second supply circuit.

12. The hydraulic system according to claim 9, comprising a dozer device, wherein the hydraulic actuator is a dozer cylinder to move the dozer device.

13. The hydraulic system according to claim 10, wherein the air release circuit is provided for one of the plurality of pilot switch valves, the one of the plurality of pilot switch valves being disposed on a downstream portion of an operation fluid tube through which the operation fluid supplied from the operation device is to flow.

* * * * *